United States Patent [19]

Fairchild et al.

[11] 4,226,476

[45] Oct. 7, 1980

[54] CONTINUOUS MINER WITH IMPROVED ROOF-TO-FLOOR ANCHORING CANOPY UNITS FOR ADVANCING AND TURNING MACHINE AND INSTALLING ROOF BOLTS

[75] Inventors: Jack R. Fairchild, Beckley; Joseph V. Lagowski, Mabscott; James W. Gordon, Bluefield, all of W. Va.

[73] Assignee: Fairchild Incorporated, Raleigh, W. Va.

[21] Appl. No.: 855,467

[22] Filed: Nov. 28, 1977

[51] Int. Cl.[2] ..... E21C 29/22

[52] U.S. Cl. ..... 299/31; 299/33; 299/64; 299/87

[58] Field of Search ..... 299/11, 12, 18, 31, 299/33, 64, 87

[56] References Cited

U.S. PATENT DOCUMENTS

| | | | |
|---|---|---|---|
| 3,445,139 | 5/1969 | Von Hippel | 299/87 |
| 3,558,194 | 1/1971 | Renzing | 299/87 |
| 3,663,054 | 5/1962 | Dubois | 299/18 |
| 3,677,603 | 7/1972 | Small | 299/31 |
| 3,939,958 | 2/1976 | Pyles | 299/11 |
| 4,046,424 | 9/1977 | Montgomery | 299/64 |

*Primary Examiner*—William F. Pate, III

*Attorney, Agent, or Firm*—Cushman, Darby & Cushman

[57] ABSTRACT

A continuous mining machine comprising a central longitudinally extending conveyor assembly, a pair of cutting and conveying mechanisms mounted on the forward end of the central conveyor assembly for movement between a normal operating position wherein the cutting and conveying mechanisms are in alignment and extend laterally outwardly with respect to the forward receiving end of the conveyor assembly and a transporting position wherein the cutting and conveying mechanisms are in parallel relation alongside the central portion of the conveyor assembly, the cutting and conveying mechanisms having vertically movable endless track assemblies operable to move the continuous mining machine when the cutting and conveying mechanisms are in the transporting position, and a pair of mine floor-to-roof anchoring canopy units for (1) advancing the continuous mining machine so that the cutting and conveying mechanisms are moved inwardly of the working face, (2) facilitating the installation of mine roof bolts at positions close to the working face while affording roof protection to the operators, and (3) effecting a 90° turning movement of the continuous mining machine.

32 Claims, 21 Drawing Figures

Fig. 12
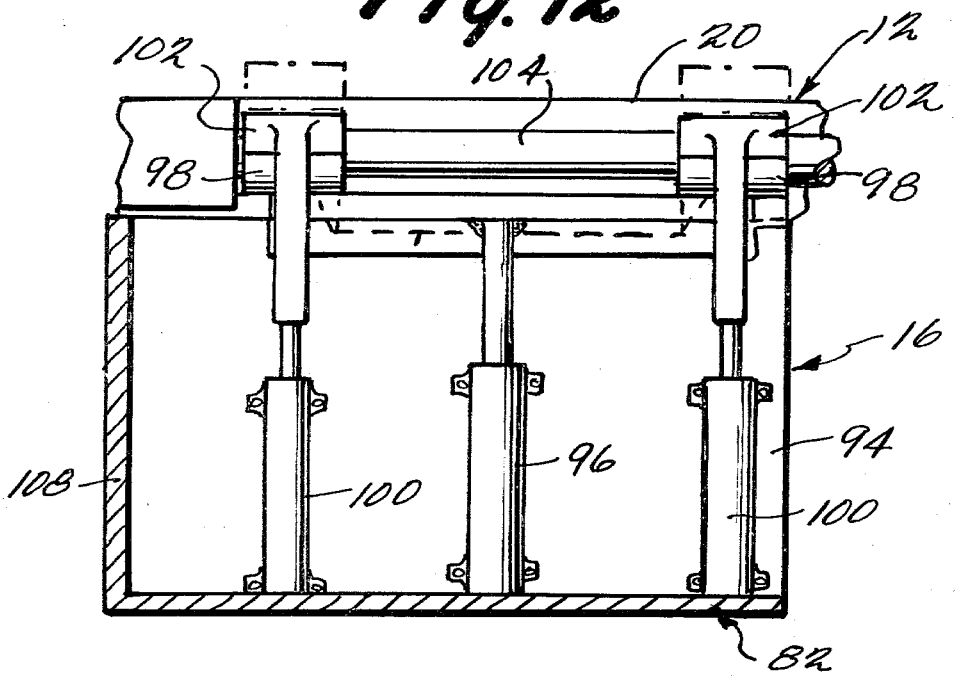
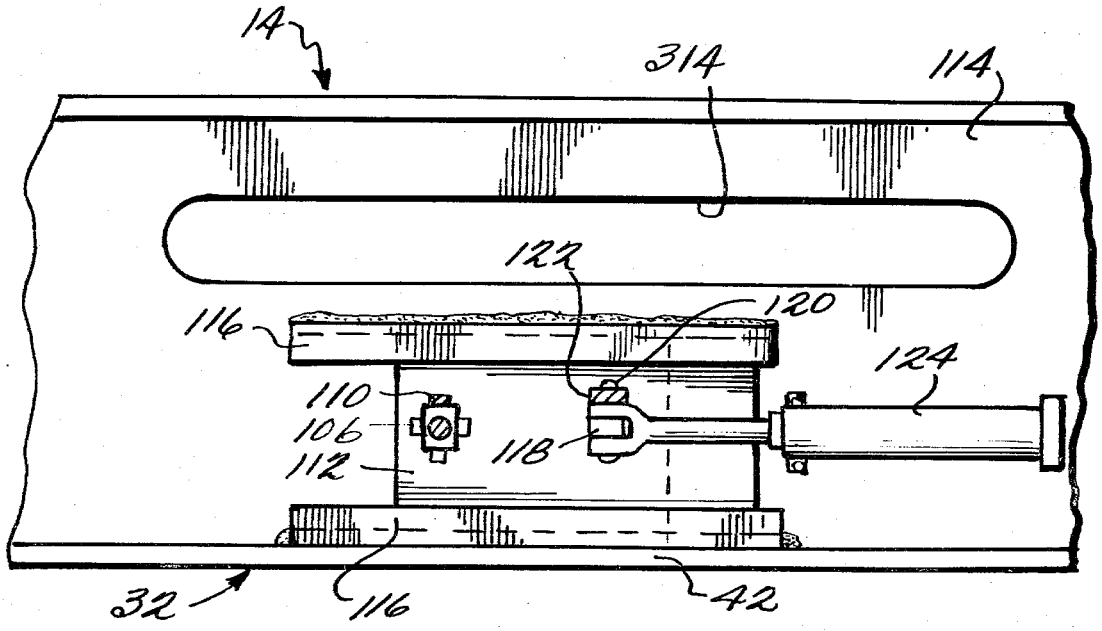
Fig. 13

CONTINUOUS MINER WITH IMPROVED ROOF-TO-FLOOR ANCHORING CANOPY UNITS FOR ADVANCING AND TURNING MACHINE AND INSTALLING ROOF BOLTS

This invention relates to continuous mining machines and more particularly to improvements in such machines relating to the mechanism for advancing and turning the machine and installing roof bolts during the advancing movements.

The type of continuous mining machine herein contemplated is the type that operates on the so-called shortwall system of mining, as distinguished from the longwall system. In a conventional longwall system of mining, two parallel entries are formed in the seam a considerable distance from one another. A starting entry is formed between the two parallel entries at one end and the longwall mining machinery is then set up in the cross entry. Usually, the system includes a series of spaced roof supporting assemblies which are operable to be advanced as the cutting along the face of the cross entry proceeds. (See, for example, U.S. Pat. Nos. 3,439,508 and No. 3,524,680.) An advantage of the longwall system is that as the roof supporting assemblies advance with the cutting, the roof rearwardly of the assemblies is allowed to collapse, so that there is no necessity to provide permanent type roof supports, such as roof bolts or the like.

In contradistinction, shortwall mining equipment usually requires the utilization of permanent roof supports, such as mine roof bolts, particularly when cutting entries which are to be subsequently used in the mining operation. A characteristic of a shortwall machine is that since the face of the seam which is being worked by the machine is relatively narrow, as compared with the width of the working face in a longwall system, the cutting must proceed in an advancing direction inwardly of the working face much more rapidly than is the case in a longwall system. Moreover, there is generally speaking a greater need for mobility of the machine within the seam.

Because of these characteristics, shortwall continuous mining machines have generally been provided with endless tracks as a means to achieve the necessary mobility and speed of advancement. Machines of this type are characterized by their extensive weight since traction, even of endless track assemblies, is dependent to some extent upon the load carried thereby. Not all of the commercially available shortwall continuous mining machines utilize endless track assemblies for advancement and mobility. U.S. Pat. No. 3,858,940 discloses a commercial continuous miner sold under the name "WILCOX Mark 20 PJ" which utilizes cable and drum assemblies for advancement and mobility. In this arrangement which is somewhat lighter, movement of the mining machine is effected by anchoring one end of the cable to an anchoring jack assembly expanded into fixed relation between the mine roof and floor.

It has been proposed in the patented literature to effect advancement of a shortwall type continuous mining machine by providing an anchor point through the expansion of an anchoring jack device between the mine roof and floor and effecting movement of the machine from the anchor point by means of a hydraulic piston and cylinder unit, rather than a cable and drum assembly (see, for example, U.S. Pat. No. 3,169,796). It has also been proposed to provide a shortwall continuous mining machine advanced by endless tracks with a vertically movable canopy structure capable of providing mine roof protection in a localized area (see, for example, U.S. Pat. No. 2,711,634). Also known in the art is the provision of separate mechanisms which are useful in installing mine roof bolts, see for example, U.S. Pat. No. 3,849,995.

An object of the present invention is the provision of a continuous mining machine operable on the shortwall principle which is provided with improved roof-to-floor anchoring canopy units having means for effecting the advancement of the cutting and conveying mechanism of the machine into the working face and the turning of the machine within an entry through a 90° turn and means for facilitating the installation of roof bolts in a position near the working face. A preferred type of cutting and conveying mechanism embodied in the continuous mining machine of the present invention is the lateral horizontal axis auger type disclosed in U.S. Pat. No. 3,044,753. In accordance with a preferred feature of the invention, the auger is divided into two cutting and conveying mechanisms which are interrelated to one another in the manner indicated in the aforesaid patent when in a normal operating position but are capable of being swung rearwardly with respect to one another into a transporting position providing a foreshortened width.

Reference is here made to U.S. Pat. No. 3,128,998 which discloses a pair of auger type cutting and conveying mechanisms which are mounted on the forward end of an endless track frame for movement from a normal operating position in which the axes of rotation of the cutting and conveying mechanisms are inclined forwardly and outwardly with respect to one another and are capable of movement forwardly into a position wherein the axes are parallel and the auger cutters are in side-by-side relation. However, it is noted that the arrangement of the patent is such that the auger cutters cannot be operated with their axes in alignment nor can they be swung rearwardly into a transport position.

Preferably the two cutting and conveying mechanisms are each provided with a power driven endless track assembly, which are disposed in parallel relation with respect to one another when the two mechanisms are disposed in their transport positions so that the endless track assemblies can be lowered and used to provide transporting movement of the machine.

In accordance with the principles of the present invention, when the cutting and conveying mechanisms are disposed in their operative positions, they serve to cut the coal from the same and move the same laterally inwardly to the leading end of a longitudinally extending conveyor assembly which serves to transport the coal rearwardly and discharge it from its rearward end onto a conveyor assembly of the type disclosed in U.S. Pat. No. 3,306,667. In accordance with the principles of the present invention, two canopy units are provided on opposite sides of the central portion of the conveyor assembly rearwardly of the two laterally extending cutting and conveying mechanisms. Each unit includes a floor engaging structure, a canopy structure including a roof engaging pivot thereon, the canopies having openings through which roof drills and roof bolts can be moved vertically into the roof. The canopy units also include power operated roof bolt installing mechanisms which include vertically movable power operated head assemblies associated with each opening, the arrangement being such that mine roof bolts can be mounted in four positions of general longitudinal alignment within the entry being worked which are spaced apart laterally a distance of about four feet between adjacent roof bolts. Moreover, the arrangement permits installation of the roof bolts during the operation of the machine within a longitudinal distance of as small as seven and one-half feet from the working face. Each canopy unit is also mounted for relative longitudinal horizontal movement with respect to the associated cutting and conveying mechanism, as by power operated hydraulic piston and cylinder units, for the purpose of effecting the advancing movements of the machine. Preferably, each canopy unit is capable of relative lateral horizontal movement with respect to the associated cutting and conveying mechanism for the purpose of enabling the canopy units to operate in a turning mode.

While in its preferred form the present invention contemplates the provision of a continuous mining machine embodying all of the preferred features described above, a further object of the present invention is to provide a machine which combines less than all of the features in a manner heretofore not suggested in the prior art.

These and other objects of the present invention will become more apparent during the course of the following detailed description and appended claims. The invention may best be understood with reference to the accompanying drawings wherein an illustrative embodiment is shown.

In the drawings

FIG. 1 is a top plan view of a continuous mining machine embodying the principles of the present invention;

FIGS. *2a* and *2b* are split views appearing on two sheets which, when combined, constitute a side elevational view of the mining machine shown in FIG. 1, with the parts shown in the position assumed at the beginning of an operating cycle;

FIGS. *3a* and *3b* are views similar to FIG. 2 with the parts shown in the position assumed at the end of an operating cycle;

FIG. 12 is a sectional view taken along the line 12—12 of FIG. 11;

FIG. 13 is a sectional view taken along the line 13—13 of FIG. 11;

Figure 15:
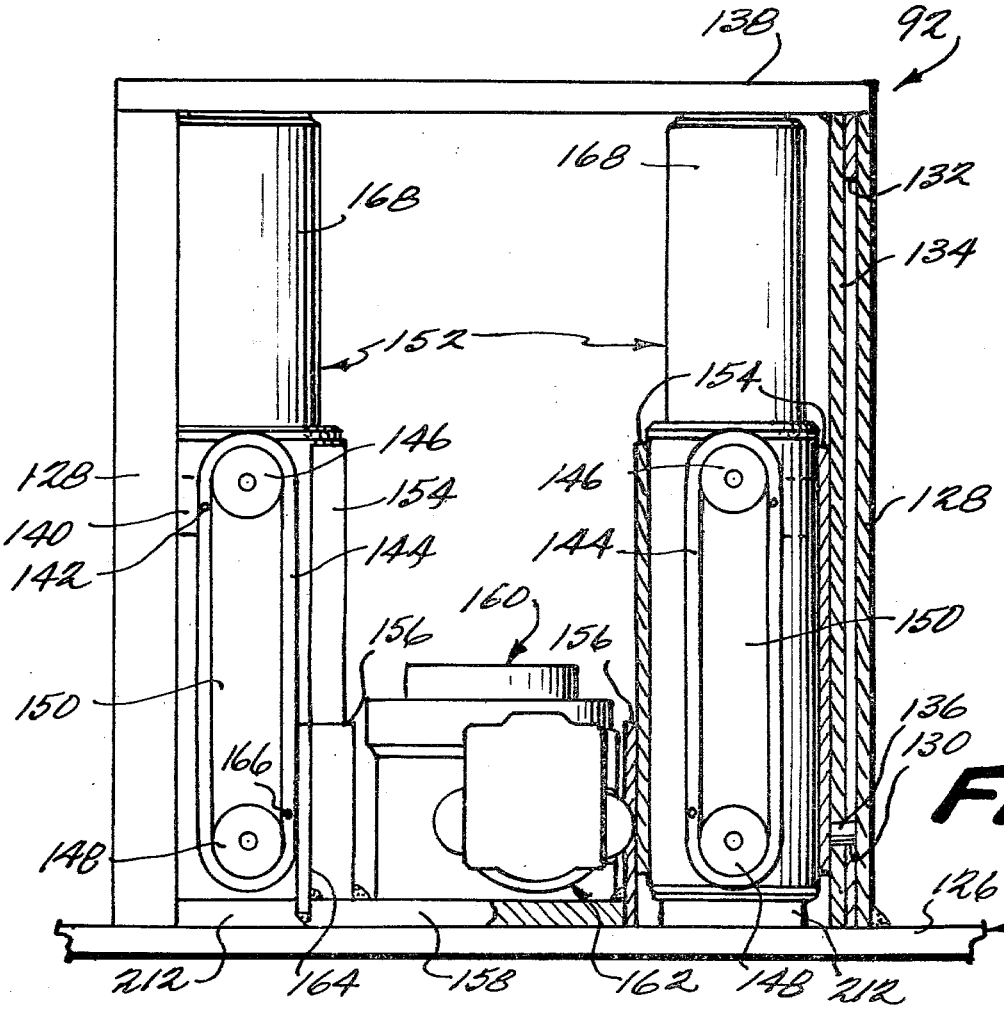
FIG. 15 is a side elevational view of the assembly shown in FIG. 14 with certain parts broken away for purposes of clearer illustration, showing the parts in a fully retracted position.
Figure 17:
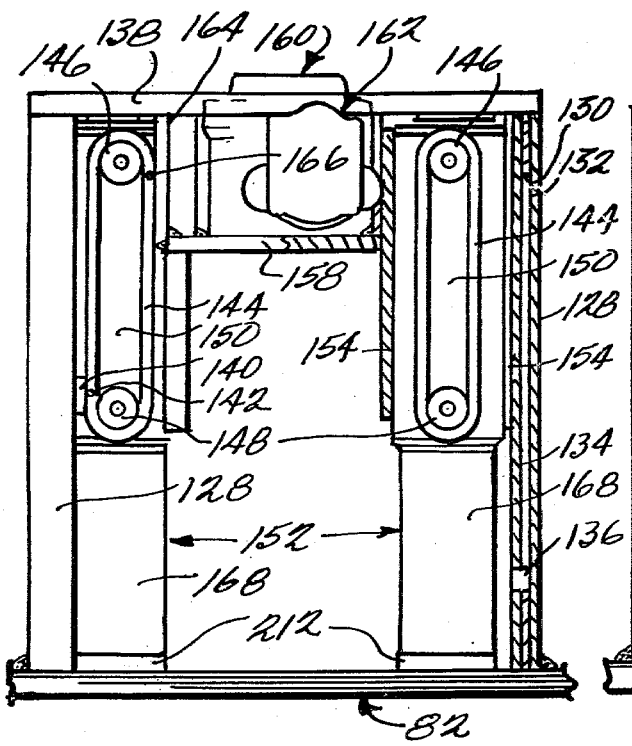
Figure 18:
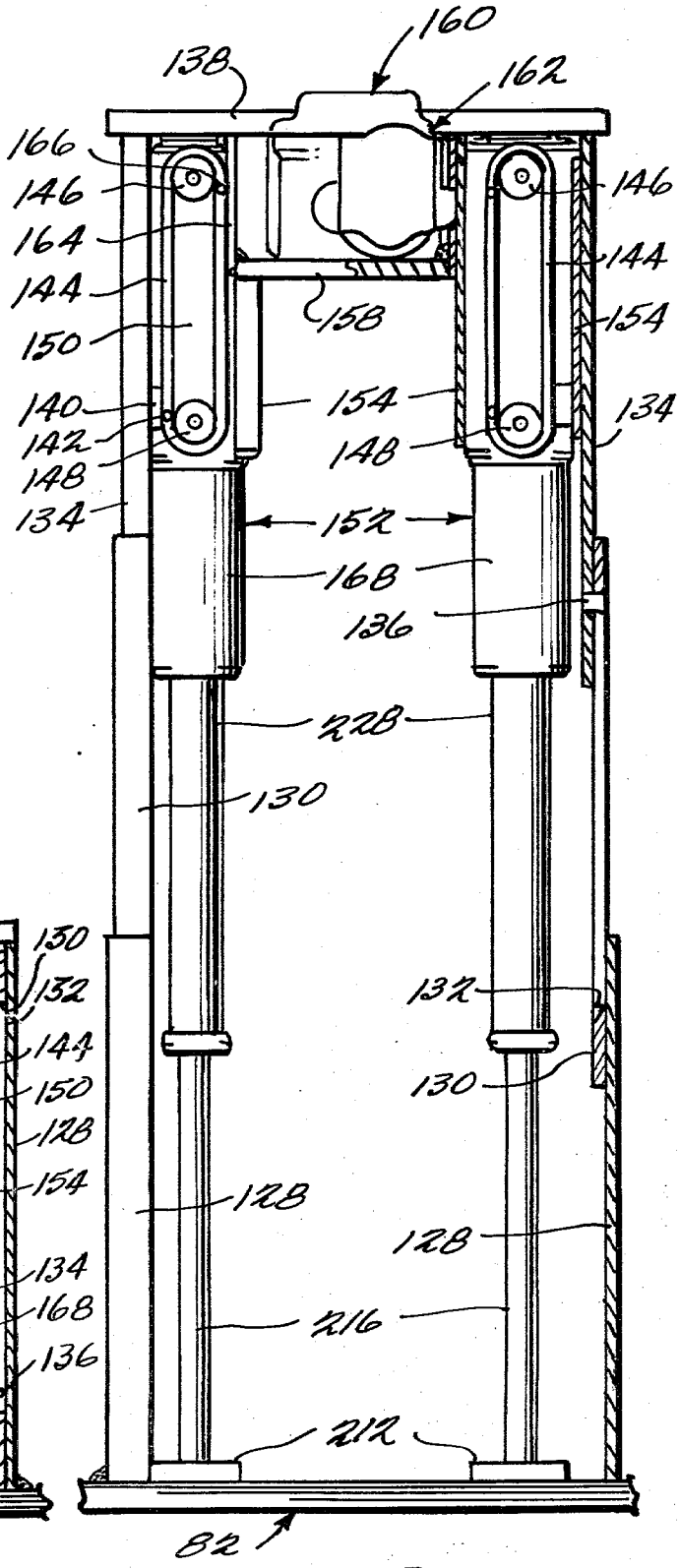

FIGS. *16a* and *16b* are divided views which, when combined, constitute an elevational view partly in vertical section of one of the telescopic units of the roof bolt installing assembly;

FIG. 17 is a view similar to FIG. 15 showing the parts in a first stage of extension; and FIG. 18 is a view similar to FIG. 15 showing the parts in a fully extended position.

Referring now more particularly to the drawings, there is shown therein a continuous mining machine, generally indicated at 10, which embodies the principles of the present invention. The machine 10 is provided with power operated cutting and conveying means which includes a centrally located longitudinally extending conveyor assembly, generally indicated at 12, the forward end of which constitutes a receiving end of the conveyor assembly and the rearward end of which constitutes the discharge end thereof. A pair of cutting and conveying mechanisms, generally indicated at 14, is mounted in laterally outwardly extending relation from the forward receiving end of the conveyor assembly 12. Mounted rearwardly of each cutting and conveying mechanism 14 is a floor-to-roof anchoring canopy unit, generally indicated at 16, which performs the multiple functions of (1) advancing the continuous mining machine 10 so that the cutting and conveying mechanisms 14 are moved inwardly of the working face, (2) facilitating the installation of mine roof bolts at positions close to the working face while affording roof protection to the operators, and (3) effecting a 90° turning movement of the continuous mining machine.

The conveyor assembly 12 may be of any suitable construction and, as shown, is of the scraper conveyor type embodying a rigid frame structure which includes the usual side frame plates 20 rigidly interconnected by suitable transversely extending horizontal flight plates 22. The upper flight plate 22 serves as a supporting surface for coal to be conveyed from the forward receiving end of the conveyor assembly 12 to the rearward discharge end thereof. To effect the movement of the coal along the upper flight plate 22 there is provided a power driven endless chain 24 having a series of longitudinally spaced flight elements 26 extending outwardly therefrom in opposite directions. It will be noted that the rearward end of the conveyor assembly 12 is provided with a suitable pivotal connection, generally indicated at 28, for attachment to the forward end of a bridge conveyor assembly, generally indicated at 30.

Each of the cutting and conveying mechanisms 14 includes a mine floor engaging assembly, generally indicated at 32, having mounted thereon for pivotal movement about a horizontal axis, a mounting arm assembly, generally indicated at 34. The outer end of each mounting arm assembly 34 rotatably supports an auger cutter unit 36, the axis of rotation of which is parallel with the axis of pivotal movement of the associated mounting arm assembly 34 with the associated floor engaging assembly 32. Each floor engaging assembly 32 is provided with a vertical pivotal connection, generally indicated at 38, which serves to support the associated floor engaging assembly 32 for movement between a normal operative position wherein the pivotal axes of the mounting arm assemblies 34 of both floor engaging assemblies 32 are in alignment and extend transversely at right angles to the longitudinal extent of the central conveyor assembly 12 and the axes of both auger cutter units 36 move in a common cylindrical plane concentric with the axis of movement of the mounting arm assembly and a transporting position wherein the floor engaging assemblies 32 extend rearwardly alongside the central portion of the conveyor assembly 12 with the axes of the mounting arm assemblies and auger cutter units 36 disposed generally in parallel relation with respect to one another.

Figure 1:
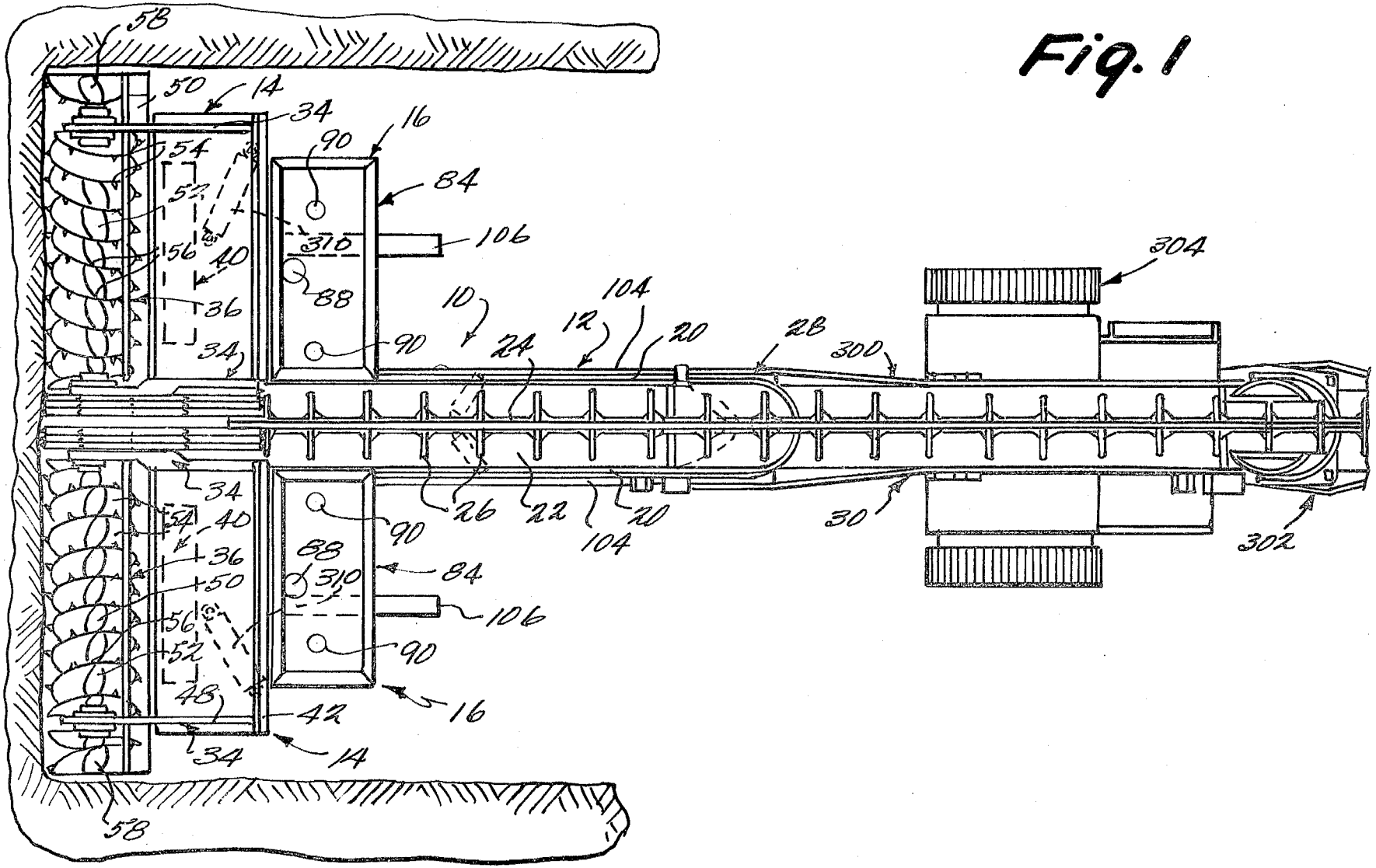
Figure 4:
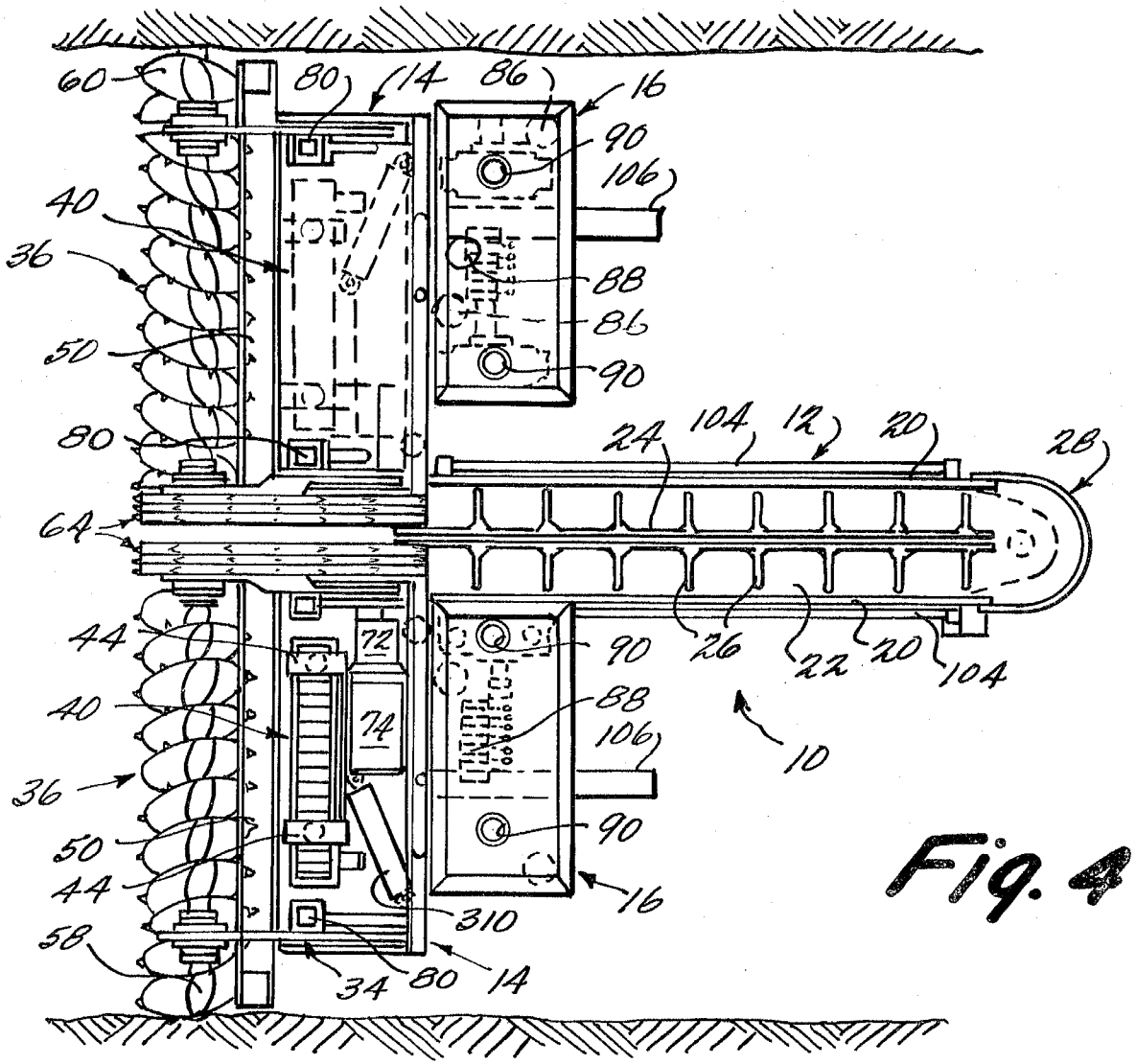
FIG. 4 is a top plan view of the forward portion of the continuous mining machine showing the parts in a position assumed prior to a 90° turning movement of the machine within an entry.
Figure 8:
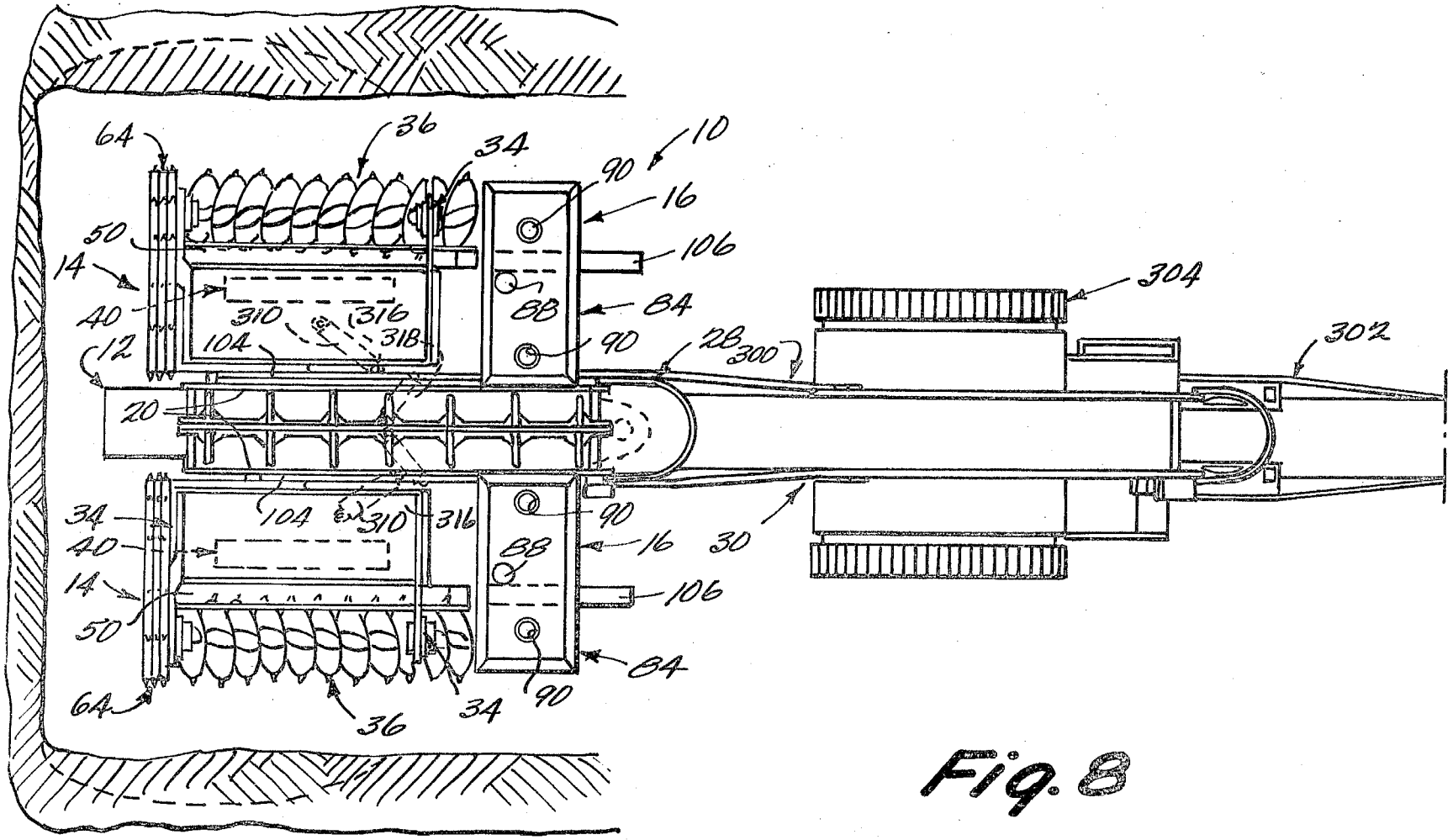
FIG. 8 is a top plan view of the continuous mining machine showing the parts in their full transport position.
Figure 9:
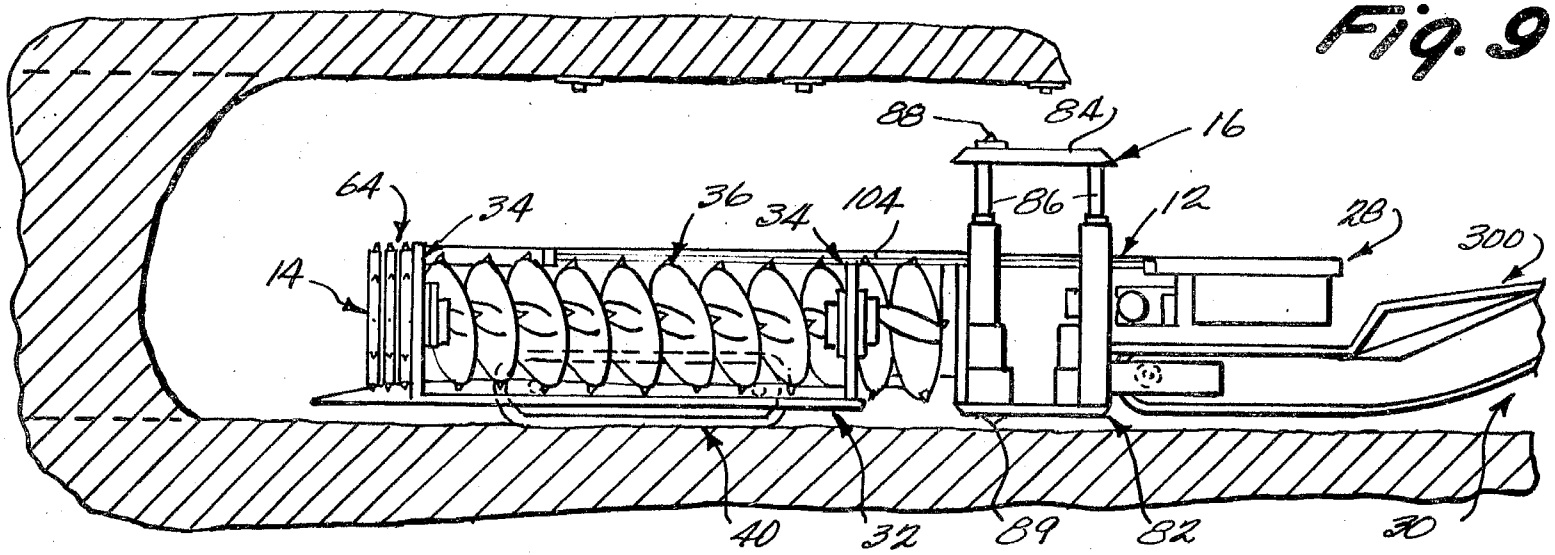
FIG. 9 is a side elevational view of the machine in the position shown in FIG. 8.
Figure 10:
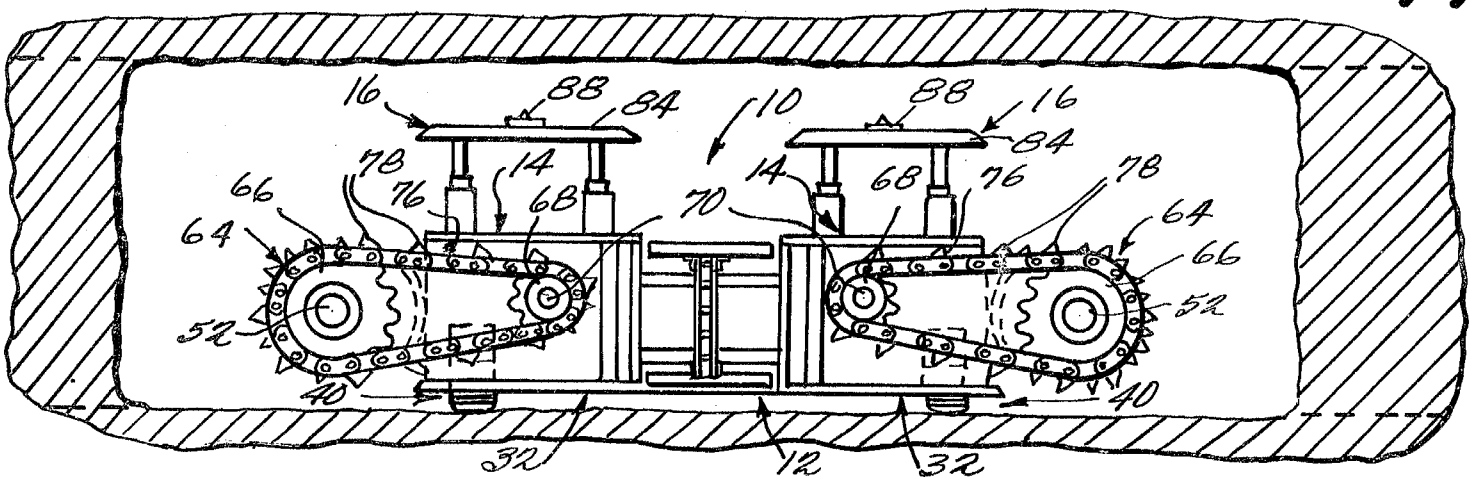
FIG. 10 is a front elevational view of the machine in the position shown in FIG. 8.
Figure 11:
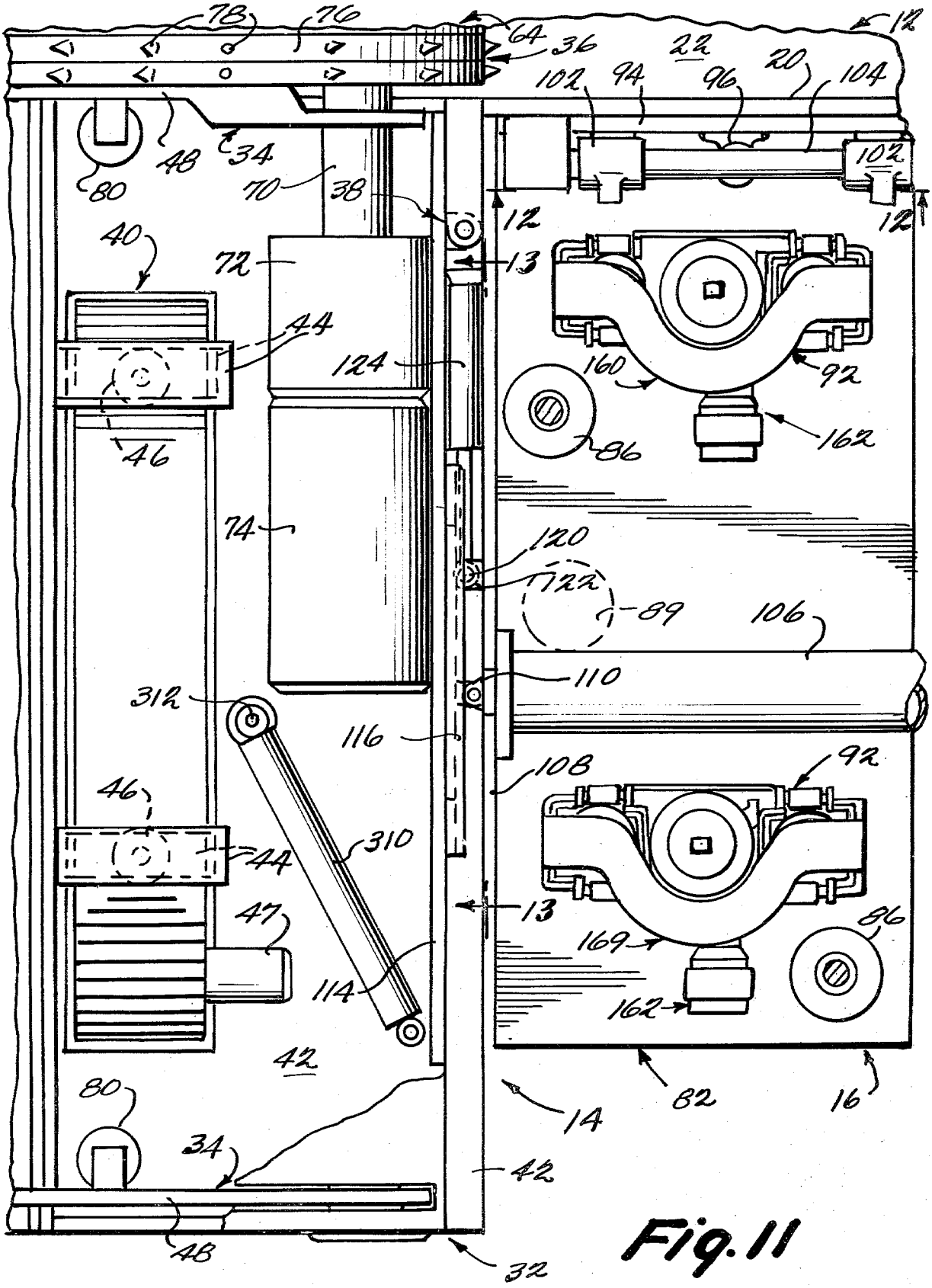
FIG. 11 is an enlarged fragmentary sectional view taken along the line 11—11 of FIG. *2a;*
Figure 14:
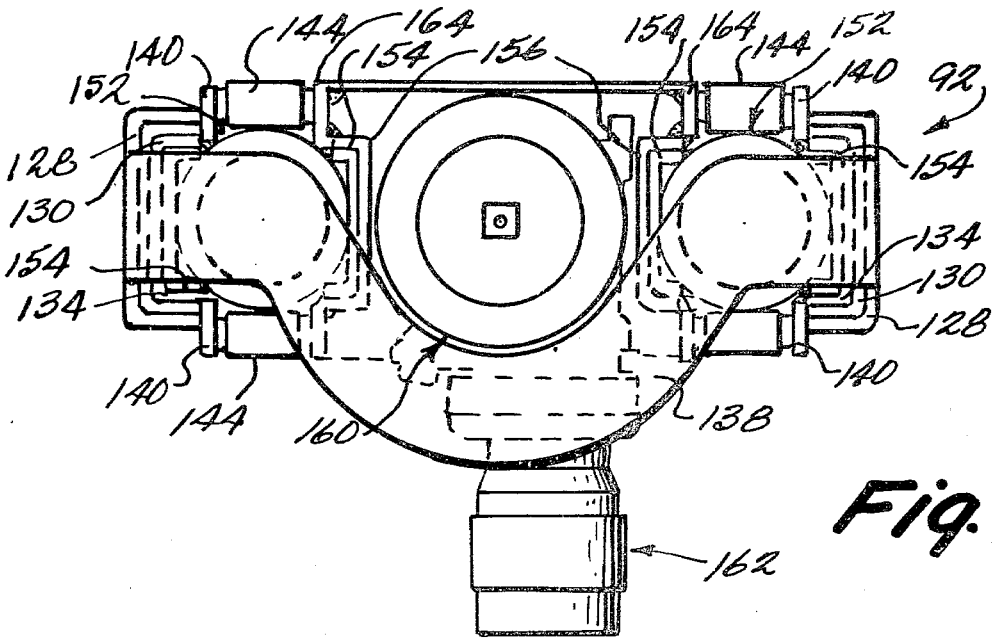
FIG. 14 is a top plan view of an assembly for facilitating the installation of roof bolts.

Preferably, to insure rapid and convenient movement of the continuous mining machine 10 from one place within the mine to another, each floor engaging assembly 32 is provided with a power driven endless track assembly, generally indicated at 40. As best shown in FIG. 11, each floor engaging assembly 32 includes a rigid box-like frame structure including a horizontally extending floor engaging plate 42 having an opening formed therein of a size suitable to receive the lower floor engaging flight of the associated endless track assembly 40. It will be noted that each endless track assembly 40 is oriented so that the floor engaging flight thereof extends transversely when the associated floor engaging plate 42 is in its normal operating position as shown in FIGS. 1 and 4 and longitudinally when the associated floor engaging plate 42 is disposed in its transport position, as shown in FIG. 8. In this way, the two endless track assemblies 40 associated with the two floor engaging plates 42, are disposed parallel to one another when in a transporting position so that they may function together in the normal fashion of a pair of endless track assemblies.

In order to relieve the wear and tear on the endless track assemblies when in a normal operating position, each endless track assembly is mounted on the assocated floor engaging plate 42 for relative vertical movement from a raised normal operating position wherein the plate functions as the primary floor engaging element of the floor engaging assembly to a lowered transporting position wherein the endless track assembly functions as the floor engaging element of the floor engaging assembly. As best shown in FIG. 11, such vertical movement is accomplished by any suitable means such as spaced pairs of inverted U-shaped yokes 44 having their bight portions interconnected by hydraulic rams 46. The legs of the outer U-shaped yoke are fixed to the associated floor engaging plate, while the legs of the inner U-shaped yoke are connected to the frame of the endless track assembly 40. Also, as best shown in FIG. 11, each endless track assembly is power driven as by a hydraulic motor 47.

Each mounting arm assembly 34 includes a pair of longitudinally spaced plate-like arms 48 having one of their ends mounted for pivotal movement on the associated floor engaging plate 42. Connected between an intermediate portion of the two arms and extending laterally outwardly from the laterally outermost arm 48 is an arcuate blade element 50. Each auger cutter unit 36 may be of any known design and, as shown, preferably includes a main auger cutter section journaled between the two mounting arms 48 consisting of a central shaft 52, a pair of helical blades 54 displaced 180° with respect to one another and extending radially outwardly from the shaft 52, and a multiplicity of cutting teeth 56 spaced along the periphery of the blades 54 in longitudinally spaced relation with respect to one another. Each auger cutter unit 36 also preferably includes an outer auger cutter section consisting of a stub shaft 58, a pair of helical blade sections 60 and a series of teeth 62, fixed to the outer extent of the helical blades and to the peripheral extent thereof in the manner previously indicated. Each auger cutter unit 36 also preferably includes an inner chain cutting section 64 which consists of a forward sprocket wheel 66 fixed with respect to the adjacent shaft 52, a rearward driving sprocket wheel 68 fixed to the output shaft 70 of a speed reducing unit 72, mounted on the associated floor engaging plate 42. Each output shaft 70 extends coaxially through the pivotal axis of the associated mounting arm 48. Each speed reducing unit 72 is driven by an electric motor 74 fixed to the associated floor engaging plate 42 and drivingly connected with the associated speed reducing unit. The chain cutter section 64 also includes a series of endless chains 76 having longitudinally spaced peripheral cutting teeth 78 fixed thereto trained about the associated sprocket wheels 66 and 68. It will be noted that the direction of rotation of the motors 74 is such that the lower flights of the chains 76 move rearwardly. In this way, the chains serve to not only cut and convey coal from the face rearwardly, but in addition, serve as a driving means for the main and outer auger sections.

It will be noted that each of the mounting arms 48 has connected thereto the piston rod end of a hydraulic piston and cylinder unit 80, the cylinder end of which is suitably pivotally connected with the adjacent portion of the associated floor engaging plate 42.

Each of the units 16 includes a mine floor engaging structure, generally indicated at 82. Mounted above each floor engaging structure 82 is a roof engaging canopy structure 84 which, as shown, is of generally rectangular configuration in plan providing a protected roof area thereabove of approximately $3\frac{1}{4}' \times 6'$. Each canopy structure 84 is mounted for vertical movement with respect to the associated floor engaging structure 82 by a pair of hydraulic rams 86. By extending the hydraulic rams 86 the canopy structure 84 is adapted to move into anchored relation with respect to the roof so as to provide a protected area below the canopy for an operator. It will be noted that the upper surface of the canopy is provided with a roof engaging conical pivot member 88 which serves to dig into the roof and effect the anchored relationship between the mine roof and mine floor of the floor engaging structure 82. A similar vertically aligned pivot member 89 is provided on each floor engaging structure 82.

Each canopy structure 84 is formed with a pair of longitudinally aligned laterally spaced openings 90. The laterally innermost opening is spaced from the center line of the conveyor assembly 12 approximately 2' and from the outermost opening a distance of approximately 4', so that when the pair of canopy structures is disposed in longitudinal alignment all four openings 90 are in longitudinal alignment with a space of approximately 4' between each pair of adjacent openings. Carried by each floor engaging structure 82 is a pair of roof bolt installing assemblies, generally indicated at 92, so positioned as to facilitate the installation of mine roof bolts in the mine roof through the associated pair of openings 90.

Each floor engaging structure 82 is mounted for relative longitudinal horizontal movement with respect to the associated auger cutter unit 36 and central conveyor assembly 12. While any suitable means may be provided for effecting this mounting, as shown, the floor engaging structure 82 includes an inner vertical plate 94. As best shown in FIG. 12, fixed to the laterally outward surface of the plate 94 is the cylinder end of a first vertically extending hydraulic piston and cylinder unit 96, the upper piston rod end of which is fixedly connected to a pair of upwardly facing C-shaped slide elements 98. Mounted on the plate 94 on opposite sides of the unit 96 is a pair of hydraulic piston and cylinder units 100. As before, the cylinder ends of the units are fixed to the plate 94 and the piston rod ends are fixed to a pair of downwardly facing C-shaped slide elements 102.

Mounted on adjacent side frame plate 20 of the central conveyor assembly 12 is an elongated rod 104 of a size to be slidably received within the C-shaped slide elements 98 and 102 when the same are moved into cooperative engagement by the introduction of hydraulic fluid under pressure to the appropriate ends of the hydraulic piston and cylinder units 96 and 100. The mounting of each floor engaging structure 82 with respect to the associated auger cutter unit 36 also includes a telescopic unit 106 which is in the form of a hydraulic piston and cylinder unit. As best shown in FIG. 11, the cylinder of the unit 106 is rigidly secured to a forward vertical plate 108 forming a part of the floor engaging structure 82. The piston rod end of the unit 106 extends forwardly and is pivotally connected to a clevis 110 mounted on the frame structure of the associated floor engaging assembly 32. It can be seen that the advancing movement of the mining machine 10 can be effected by the application of hydraulic fluid under pressure simultaneously to the units 106 when the roof engaging canopy units 16 are in anchored relation between the floor and the roof of the mine.

In order to effect a turning movement of the continuous mining machine 10, it is necessary to disconnect the arcuately outermost canopy unit 16 from its longitudinal horizontal sliding connection with the central conveyor assembly 12 and to effect a laterally outward horizontal movement of the floor engaging structure 82 of the associated unit. In this regard it will be noted that the provision of the vertically movable C-shaped slide elements 98 and 102 movable by the hydraulic piston and cylinder units 96 and 100 between engaged and disengaged positions provides for the disengagement previously noted. Lateral horizontal movement is provided by mounting the clevis 110 on a laterally horizontally movable plate 112. As best shown in FIG. 13, the plate 112 is mounted alongside the rearward surface of a rearward vertically extending plate 114 forming a part of the box-like frame structure of the floor engaging assembly 32. As shown, the lateral horizontal sliding movement is accomplished by means of a pair of vertically spaced slide rails 116.

Mounted on each slide plate 112 in a position laterally inwardly of the associated clevis 110 is a vertically apertured lug 118 for receiving a vertical pin 120. The pin serves to detachably connect the lug 118 with a similar lug 122 fixed to the forward surface of the associated plate 108. It can be seen that when the lugs 118 and 122 are interconnected by the pin 120 the associated canopy unit 14 is connected to the plate 112 for lateral horizontal movement therewith. Such movement is effected by means of a hydraulic ram 124 having its cylinder end fixed to the rear surface of the plate 114 and its piston rod end connected with the lug 118 by the pin 120.

Referring now more particularly to FIGS. 14–18, there is shown therein a preferred embodiment of the roof bolt installing assembly 92. As shown, each assembly 92 is fixedly mounted on a horizontal plate 126 forming the floor engaging plate of the floor engaging structure 82. Fixedly secured to the plate 126, as by welding or the like, is a pair of horizontally spaced vertically extending outer channel members 128. Mounted within each of the outer channel members 128 is an intermediate channel member 130 having vertical slot 132 formed centrally in the bight portion thereof. Slidably mounted within each intermediate channel member 130 is an inner channel member 134 having a pin 136 extending outwardly therefrom into the associated slot 132. The upper end of each inner channel member 134 is rigidly connected, as by welding or the like, to an arcuately bent top plate 138. Fixed in the central portion of the free ends of the legs of each inner channel member 134 is a laterally outwardly extending lug 140. Each lug 140, which by virtue of the connection previously recited is fixed with respect to the top plate 138, has a connection, indicated at 142, with an endless chain 144 trained about two vertically spaced sprocket wheels 146 and 148 carried by an outer cylindrical member 150 of a multiple telescoping hydraulic piston and cylinder unit, generally indicated at 152.

It will be noted that the periphery of each outer cylindrical member has welded thereto a pair of diametrically opposed guide channel members 154, the outer one of which is slidably mounted within the associated inner channel member 134 and the inner one of which has slidably mounted thereon a relatively short channel section 156. The lower end of each channel member 156 is rigidly fixed, as by welding or the like, to an adjacent end of a horizontally extending plate 158. Mounted on the plate is a rotating head assembly 160 of known design adapted to receive successively a mine roof drill and a mine roof bolt. The head 160 has connected therewith a hydraulic motor assembly 162 for the purpose of effecting controlled rotational movement thereof. Fixed to each free end of each lg of each of the short channel sections 156 is a laterally extending plate section 164 having a connection, indicated at 166, with the opposite flight of the endless chain 144 from the flight of connection 142.

Figure 16A:
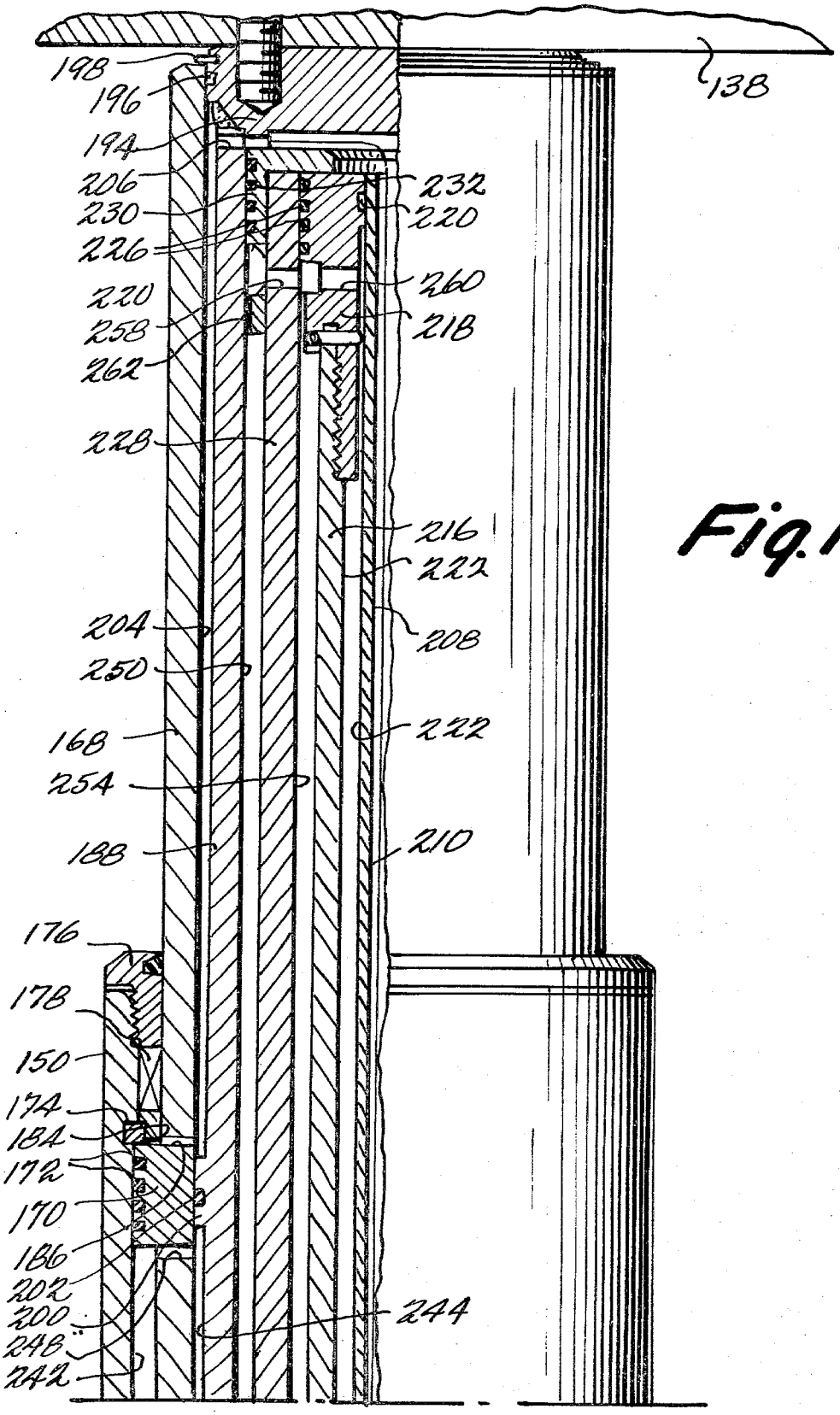
Figure 16B:
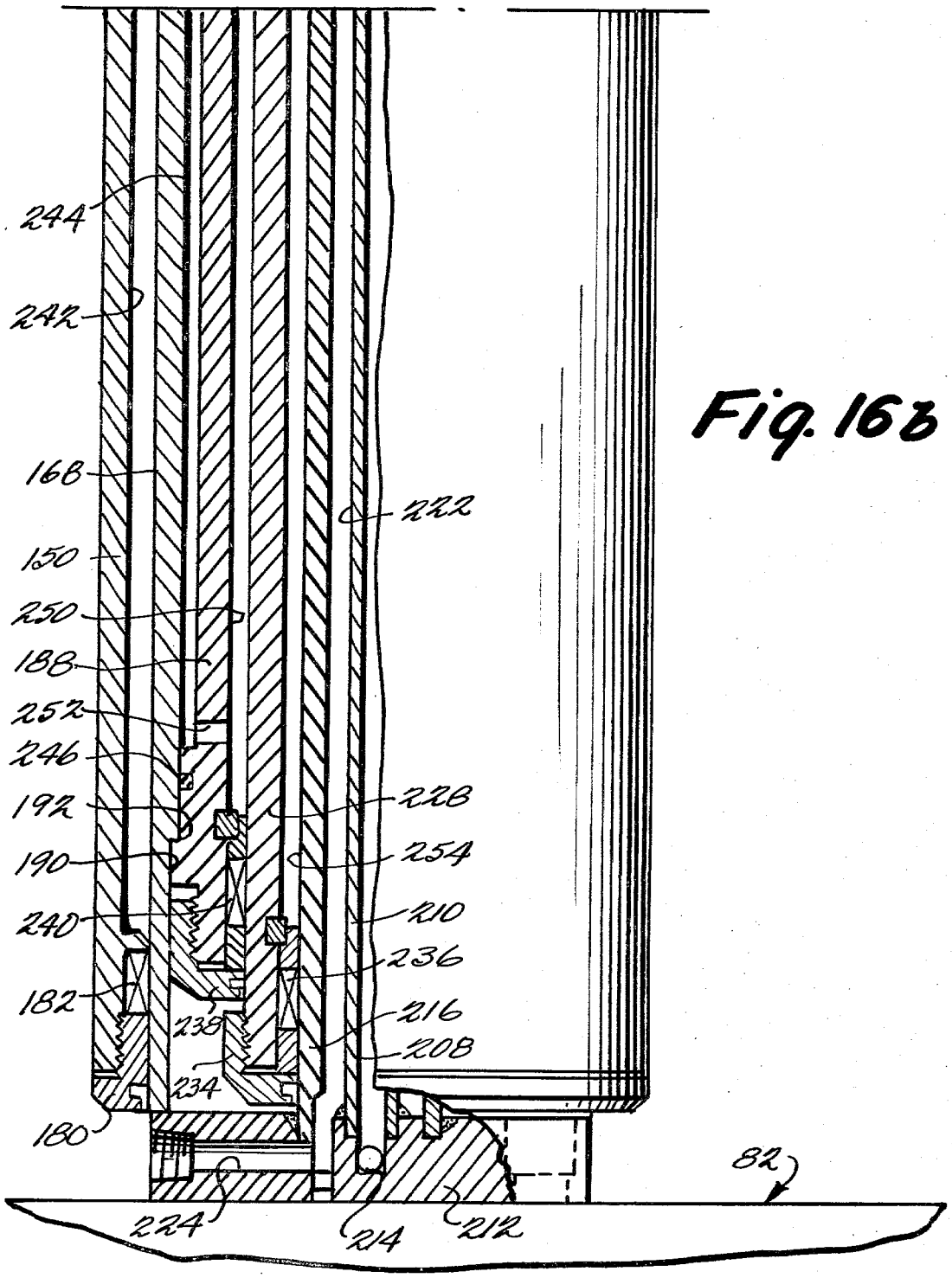

Referring now to FIGS. 16*a* and 16*b*, it will be noted that each of the multiple telescoping piston and cylinder units 152 includes a large outer cylindrical member 168 of a height approximately twice the height of the outer cylinder 50. The central portion of the cylindrical member 168 is formed with an annular sealing ring flange section 170 which extends radially outwardly therefrom and is sealingly slidably engaged with the inner periphery of the outer cylinder 150 as by peripheral seals 172. A stop ring 174 is provided on the inner periphery of the cylinder 150 for engaging the central section 170 and limiting downward movement thereof. The upper end of the outer cylinder 150 has a ring cap 176 threadedly engaged therewith which sealingly engages the exterior periphery of the cylindrical member 168 and an annular seal 178 is provided below the ring cap and above the stop ring 174 between the interior periphery of the cylinder 150 and the exterior periphery of the cylinder 168. In a like manner, the lower end of the outer cylinder 150 has a ring cap 180 threadedly engaged therewith and an annular seal 182. It can be seen that there is provided an annular space 184 between the member 170 and 178 which, when supplied with hydraulic fluid under pressure, will increase, thus effecting the raising movement of the outer cylinder with respect to the outer cylindrical member 168. Hydraulic fluid is introduced into the space 184 through a series of radial openings 186 communicating with the interior periphery of the cylindrical member 168.

Mounted within the outer cylindrical member 168 in axially fixed relation therewith is an inner cylindrical member 188. The member 188 is insertable upwardly into the member 168 into a position wherein an upwardly facing shoulder 190 on the lower end of member 188 engages a downwardly facing shoulder 192 on the lower end of the member 168. The upper end of the member 188 has a disc cap 194 fixedly secured thereto, as by welding or the like, which disc cap is sealingly engaged within the upper end of the member 168 as by a seal 196. As shown, the member 188 is retained within the member 168 as by a retaining ring 198. Extending radially outwardly from the central portion of the member 188 is an annular flange 200 which sealingly engages the central portion of the member 188 as by a seal 202. The seal 202 provides an upper annular space 204 between the inner periphery of the member 168 and the outer periphery of the member 188 which communicates with the space 184 through openings 186. The upper end of the member 188 is provided with a series of radially extending annularly spaced openings 206 which serve to communicate the space 204 with a central opening 208 formed in a central inner annular member 210 fixed centrally to a base 212. The base includes a first radial opening or passage 214 which communicates with the interior opening 208 of the fixed central annular member 210 and in this way fluid under pressure is introduced into the space 184 and removed from the space 184. Also fixed to the base 212 is an outer fixed annular member 216 which is concentric with the member 210. The upper end of the member 216 has a hollow piston 218 fixed thereto which provides for a fixed seal with the exterior periphery of the member 208, as indicated at 220. The interior periphery of the member 216 and the coextensive exterior periphery of the member 204 defines an annular space 222 below the seal 220 which is communicated exteriorly of the base 212 through a radial opening or passage 224. The outer periphery of the hollow piston 218 slidably sealingly engages, as by peripheral seals 226, the inner periphery of an intermediate cylinder or cylindrical member 228. The upper end of the intermediate cylinder is likewise provided with a hollow piston 230 which has a slidable sealing connection with the inner periphery of the member 188 as indicated at 232.

The lower end of the intermediate cylinder 228 has a hollow cap 234 threadedly engaged thereon which serves to maintain a packing assembly 236 in sealing relation with the exterior periphery of the fixed outer annular member 216. In a like manner, the lower end of the member 188 has a hollow cap 238 which activates an annular sealing assembly 240 which sealingly engages the exterior periphery of the intermediate cylinder 228.

The interior periphery of the outer cylinder 150 defines with the coextensive exterior periphery of the member 168 between the central seal 172 and lower seal 182 an annular space 242 which communicates with an annular space 244 between the inner periphery of the member 168 and the outer periphery of the member 188 between the central seal 202 and a lower seal 246 through a series of annularly spaced radially extending openings 248 formed in the member 168 below the central flange portion 170. The space 244 is, in turn, communicated with an annular space 250 defined by the inner periphery of the member 188 and the coextensive exterior periphery of the cylinder 228 between the seals 232 and 240, as by a series of annularly spaced radially extending openings 252 extending through the member 188 adjacent the seal 246. The upper end of the space 250 is, in turn, communicated with an annular space 254 defined by the coextensive portion of the inner periphery of the intermediate cylinder 228 and the coextensive exterior periphery of the member 216 through a series of annularly spaced radially extending openings 258 extending through the upper portion of the cylinder 228. The upper end of space 254 is, in turn, communicated with space 222 by means of a series of annularly spaced radially extending openings 260 formed in the piston 218. It will be noted that the upper outer periphery of the intermediate cylinder 228 is provided with a stop ring 262 which serves to limit the upward movement of the members 168 and 188 with respect thereto.

It will be understood that the connection of the rotating head assembly 160 with the telescoping units 152 enables a maximum vertical movement within the mine between the confines of the floor and roor. The operation of the telescopic units 152 in raising the rotating head 160 from its lowermost position as shown in FIG. 15 to its raised position as shown in FIG. 18 is accomplished by introducing hydraulic fluid under pressure into opening 214 and communicating the opening 224 to the sump of the hydraulic system. It will be noted that hydraulic fluid under pressure enters the opening 214, passes upwardly through the central opening 208 and radially outwardly under the disc cap 194 through radial openings 206 into the annular passage 204. From the passage 204 hydraulic fluid flows radially outwardly through the openings 186 into the space 184 to expand the latter chamber and effect a raising movement of the outer cylindrical member 150. Simultaneously with the expansion of the chamber 184, chamber 142 contracts and the fluid therein is allowed to flow outwardly thereof through openings 248 into annular space 244, from annular space 144 through openings 252 into annular space 250, from annular space 250 through openings 258 and openings 260 into annular space 222 and outwardly of annular space 222 through opening 224.

It will be noted that by virtue of the fixed points of connection 142 of the chains 144 through the lugs 140, which are effectively fixed with respect to the cylindrical members 168 and 188 through top plate 138, the vertical movement of the outer cylinders 150 through their stroke will have the effect of moving the rotating head 160 and hydraulic pump 162 carried by the plate 158 through channels 156 through a stroke which is equal to the vertical stroke of the cylinders 150 and the movement of the chains 144. FIG. 15 illustrates the position of the parts prior to any vertical movement of the outer cylinders 150 whereas FIG. 17 illustrates the position of the parts after the outer cylinders 150 have been moved through their complete stroke and it will be noted that the rotating head 160 has been moved a vertical distance greater than the vertical stroke of the cylinders 150.

After the outer cylinders have been moved through their complete stroke, the hydraulic fluid under pressure entering opening 214 and central passage 208 acts on the under surface of the disc cap 194 to raise members 168 and 188 together with respect to cylinder 228 and members 216 and 208. Here again, as the space below the cap 194 increases, space 250 decreases and the fluid from the space 250 is allowed to flow outwardly through openings 220 and 260 into the annular space 222 and outwardly through the opening 224. When ring stop 262 is engaged, the members 168 and 188 continue upwardly, now carrying with them intermediate cylinder 228 which has the effect of reducing the volume of annular space 254. It will be noted that during the initial upward movement of cylinder 228, openings 220 pass beyond seals 226 and hence the hydraulic fluid in the contracting annular space 254 flows outwardly through openings 260 into space 222 and outwardly of opening 224.

It will be understood that the telescopic units 152 are lowered by dumping hydraulic fluid pressure acting on opening 214 to the sump. In the event that the weights involved are insufficient to effect movement of the units into the lowermost position, opening 224 can be connected to hydraulic fluid under pressure to fully contract the units into the position shown in FIG. 15.

The bridge conveyor assembly 30 may be of any suitable construction and preferably is constructed substantially in accordance with the disclosure of the aforesaid U.S. Pat. No. 3,306,667, the disclosure of which is hereby incorporated by reference into the present specification. For present purposes it is sufficient to note that the assembly includes a first conveyor section 300 having a receiving end disposed in a position to receive coal from the discharge end of the central conveyor assembly 12 of the continuous miner 10. The first conveyor section 300 is articulately connected with the discharge end of the conveyor assembly 12 so that it can swing vertically about a horizontal axis with respect thereto and swing horizontally about a vertical axis.

The bridge conveyor assembly 30 also includes a second conveyor section 302 which has an elongated receiving end supported by a pair of endless track assemblies 304. The discharge end of the conveyor section 300 is connected to ride on the elongated forward receiving end of the conveyor section 302 so as to be moved longitudinally with respect thereto, the connection also providing for articulation in a manner similar to that provided by the forward connection of the first conveyor section 300 with the continuous mining machine 10.

The second conveyor section 302 is connected with a third section 306. Here again, the discharge end of the section 302 connects with the receiving end of the section 306 in an articulated manner similar to that provided by the first section 300 and the continuous mining machine 10. The discharge end of conveyor section 306 (not shown) is adapted to ride on a floor conveyor (not shown). In this regard, reference can be made to the aforesaid patent.

ADVANCING OPERATION

Figure 2A:
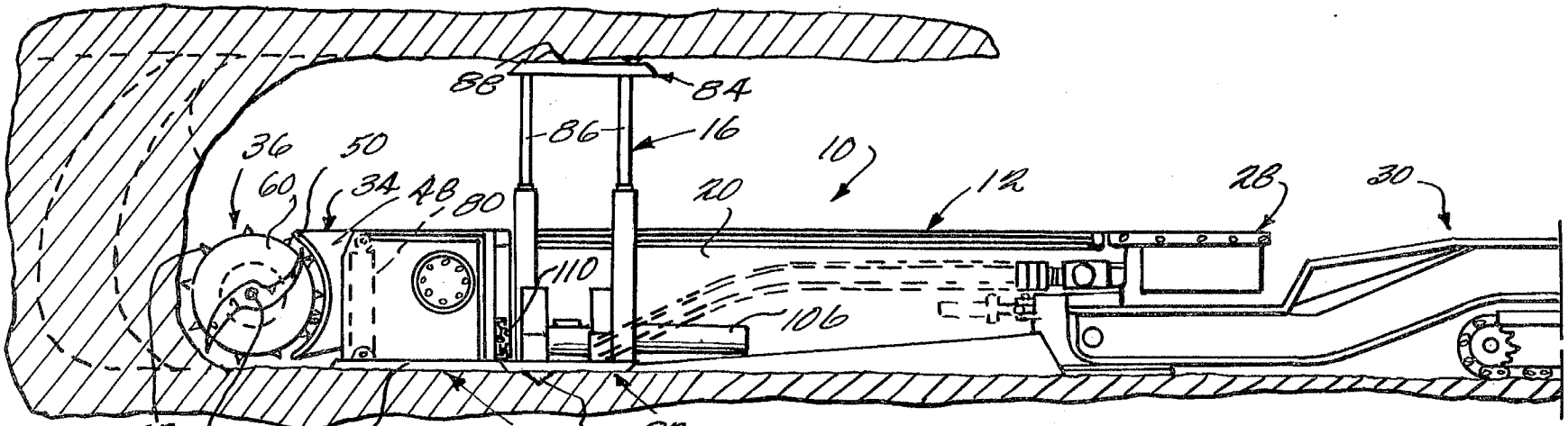
Figure 3A:
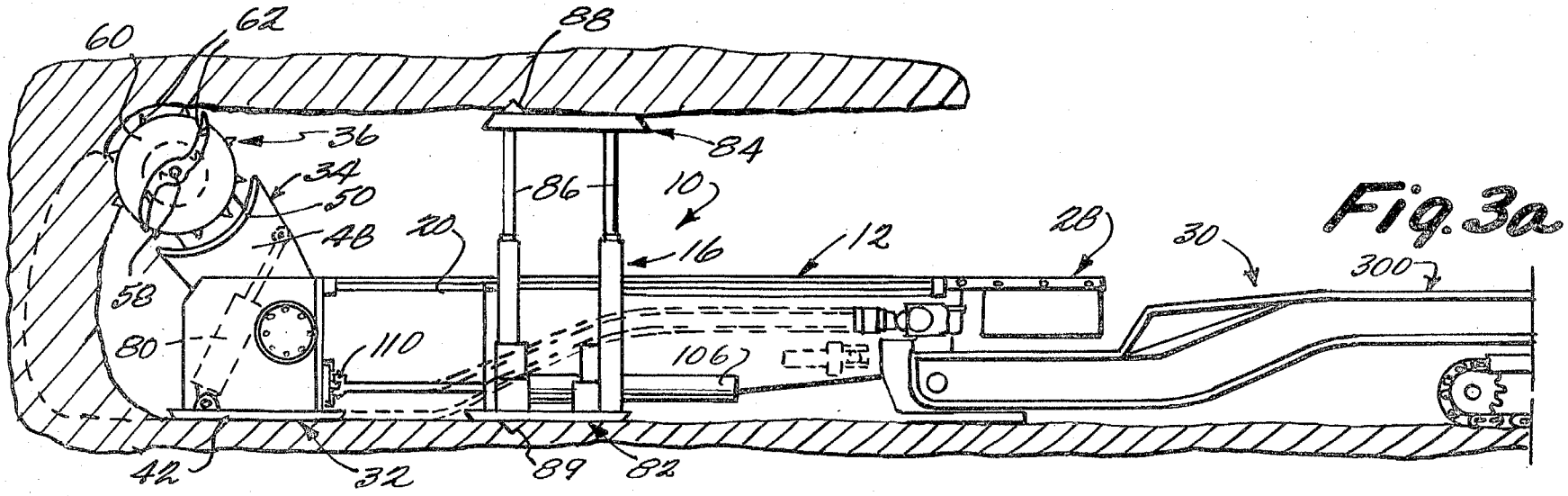
Figure 2B:
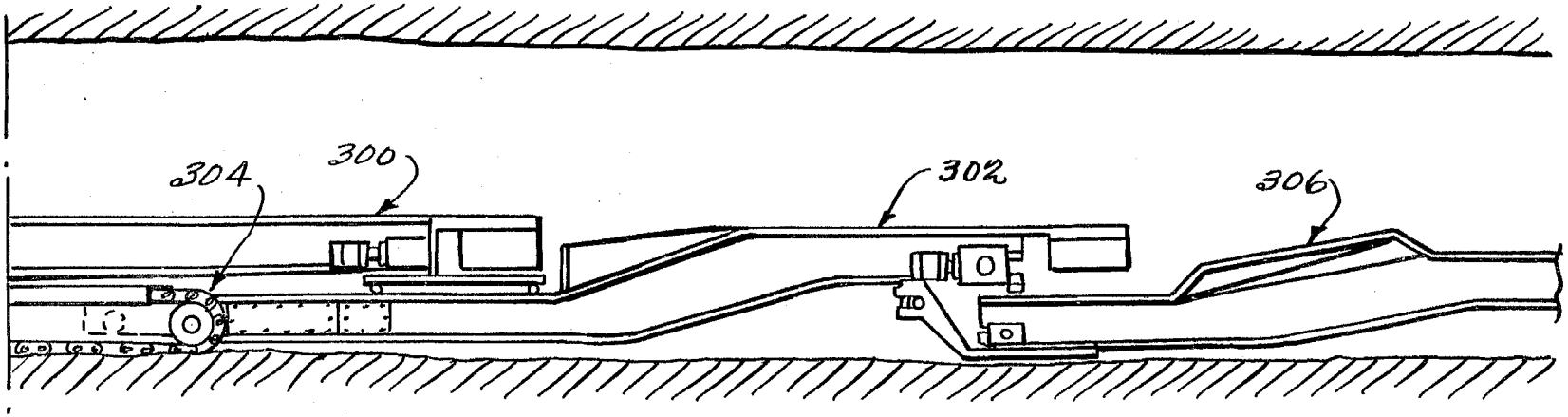
Figure 3B:
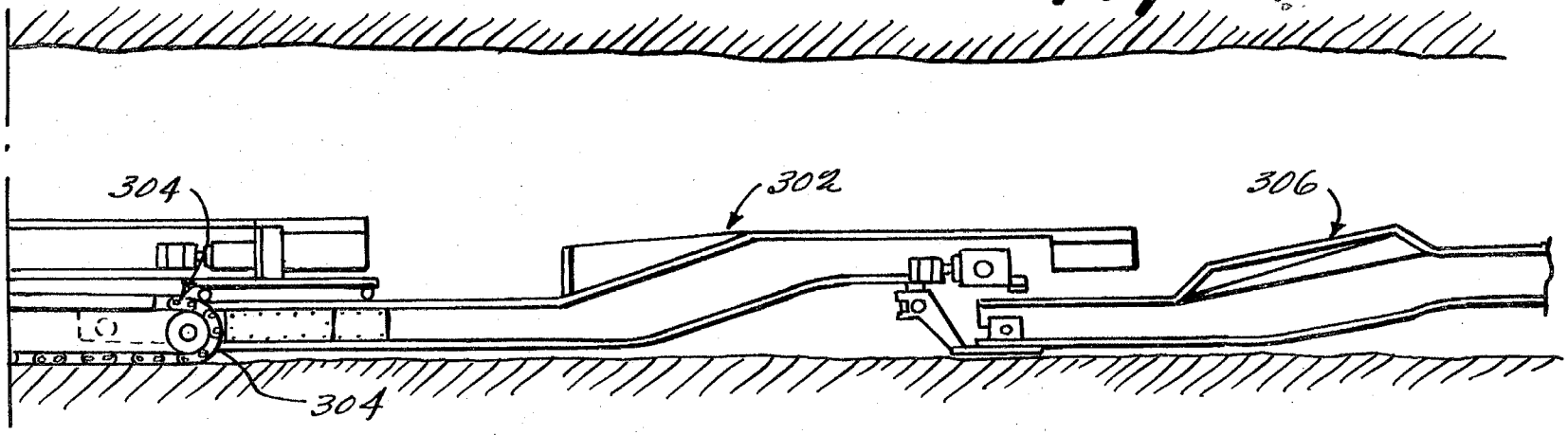

With reference to FIGS. 1–3, FIG. 2 illustrates the position of the parts of the continuous mining machine 10 which may be arbitrarily conveniently chosen as a starting point for the description of an operating cycle of the present continuous mining machine. It will be noted that during the advancing cycle the slide elements 98 and 102 are in engagement with the rods 104, hydraulic rams 124 are locked to retain the slide plates 112 against lateral movement within the slide tracks 116. Lugs 122 are disposed out of engagement with the pin 120. As shown in FIG. 2, the advancing piston and cylinder units 106 are disposed in their retracted position while hydraulic rams 86 are extended to establish the anchored relationship of the canopy structure 84 and floor engaging structure 82 of the units 16. With the units 16 in the anchored position as shown, motors 74 are energized to effect power driven actuation of the auger cutter units 36 through speed reducers 72. The auger cutter units 36 are raised upwardly into a position such as shown in FIG. 3a by suitably actuating the hydraulic rams 80. Next, hydraulic piston and cylinder units 106 are actuated which effects an advancing movement by applying advancing forces on the cutting and conveying units 14 which are resisted by the canopy units 16 anchored between the mine roof and floor. An exemplary initial advancing movement is of the order of 16" which serves to sump the auger cutter units 36 inwardly of the working face. It will be noted that the entire units 14 and central conveyor assembly 12 are moved by the hydraulic piston and cylinder unit 106 during this advancing movement, the rearward end of the central conveyor 12 carrying with it the first conveyor section 300 of the bridge conveyor assembly 30. It will be noted that during the advancing movement the rearward discharge end of the first conveyor section 300 rides on the receiving end of the second conveyor section 302 supported by the endless track assembly 304.

After the sumping movement has taken place as aforesaid, hydraulic piston and cylinder units 80 are actuated to permit the auger cutter units 36 to swing downwardly about the pivotal axis of the mounting arm assembly 34 with the floor engaging assembly 32 of the units 14. It will be noted that during the sumping in movement as well as the downward swinging movement of the auger cutter units 36, the cutting teeth 56, 62 and 78 serve to cut the material of the seam being mined while the helical blades 60 and 54 serve to effect a laterally inward conveyance of the cut material toward the chain assemblies 64 and receiving end of the central conveyor assembly 12. In this way the material inwardly of the working face of the seam is cut from the seam, conveyed inwardly toward the center and then rearwardly away from the face, ultimately discharging from the third conveyor section 306 of the bridge conveyor assembly 30 onto a floor conveyor (not shown). When the auger cutter units 36 have been fully lowered, they are again raised into their raised position by suitably actuating the hydraulic piston and cylinder units 80 and a second sumping movement of approximately 16" is made which, in turn, is followed by a lowering action. A full operating cycle includes three sumping movements of approximately 16" each, which makes a total advancement inwardly of the working face of 48" or 4'.

After the aforesaid three sumping and downward movements of the auger cutter units 36 have been accomplished, it is necessary to move the canopy units 16 and bridge conveyor assembly 30 back into the relationship shown in FIG. 2. Movement of the canopy units 16 is effected simply by lowering the hydraulic rams 86 and retracting the piston and cylinder units 106 to move the associated floor engaging structures 82 of the units into a position rearwardly adjacent the associated cutting and conveying mechanisms 16 as shown in FIG. 2. Finally, the hydraulic rams 86 are actuated to raise the associated canopy structures 84 and effect the anchored relationship of both canopy units 16 between the mine floor and roof, as shown in FIG. 2. The bridge conveyor assembly 30 is moved by actuating the endless track assembly 304 which has the effect of advancing the conveyor sections 302 and 306 a forward distance of approximately 4', while the conveyor section 302 is held stationary by virtue of the connection of the receiving end thereof with the discharge end of the conveyor assembly 12 of the continuous mining machine 10. The discharge end of the conveyor section 302 rides on the forward end of the conveyor section 302 during the forward movement of the latter.

During the total cycle when the canopy units 16 are in anchored relation, an operator stationed below each of the canopy structures 84 (where the controls for the continuous mining machine are suitably located) operates the roof bolt installing assemblies 92 in such a way as to install roof bolts through each of the associated openings 90, while the canopy structure 84 is anchored to the roof and provides protection for the operator against the roof falling within the protected area. As previously indicated, the canopy area is approximately $3\frac{1}{2}' \times 6'$ in an exemplary area of protection provided.

The manner in which the operator effects installation of the mine roof bolts with the utilization of the mine roof bolt installing assemblies 92 is as follows. With the rotating head assembly 160 disposed in its lowermost position, as shown in FIG. 15, a roof drill (not shown) is engaged within the rotating head assembly 160. Hydraulic motor 162 is then actuated to turn the head assembly 160 so that the drill will be rotated. Simultaneously with the rotation of the roof drill, the hydraulic piston and cylinder units 152 are actuated to effect a raising of the rotating head 160 carrying the rotating drill therein upwardly so that its point extends through the associated opening 90 and into the mine roof. After the rotating head assembly 160 has been moved into the uppermost position, the units 152 are actuated to lower the head into its lowermost position. The roof drill is then removed from the rotating head 160 and the head of a roof bolt assembly is engaged therewith. Units 152 are again actuated to raise the head assembly 160 carrying the roof bolt assembly engaged therein upwardly into the hole previously drilled by the drilling bit into the mine roof bolt. When the head has reached its uppermost position, hydraulic pump 162 is actuated to effect rotation of the head which, in turn, turns the head of the roof bolt assembly and effects a securement of the roof bolt assembly within the mine roof. Units 152 are then actuated to lower the head to the position shown in FIG. 15. It will be understood that the above procedure is carried out successively with each of the pairs of assemblies 92 provided so that there is mounted within the mine roof during each 4' advance, four mine roof bolts which are aligned longitudinally and spaced laterally apart approximately 4' between adjacent roof bolts and between each outer roof bolt and the adjacent side wall of the entry being mined. It is of significance to note that at the start of each 4' advancing cycle the longitudinal position at which the roof bolts are installed is approximately $7\frac{1}{2}'$ from the working face.

TURNING OPERATION

Figure 5:
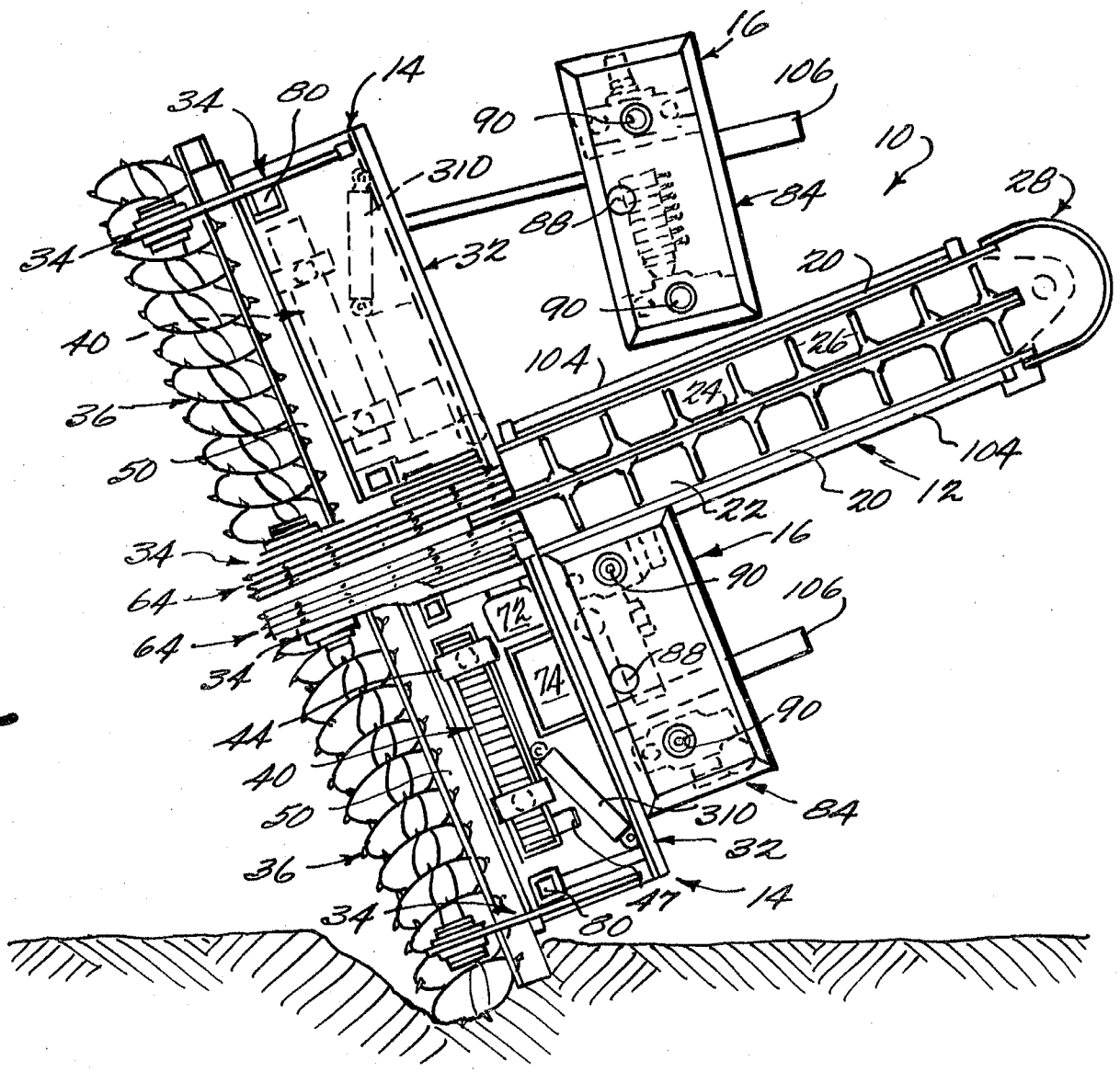
FIG. 5 is a view similar to FIG. 4 showing the parts in the position assumed after an initial position of turning movement.
Figure 6:
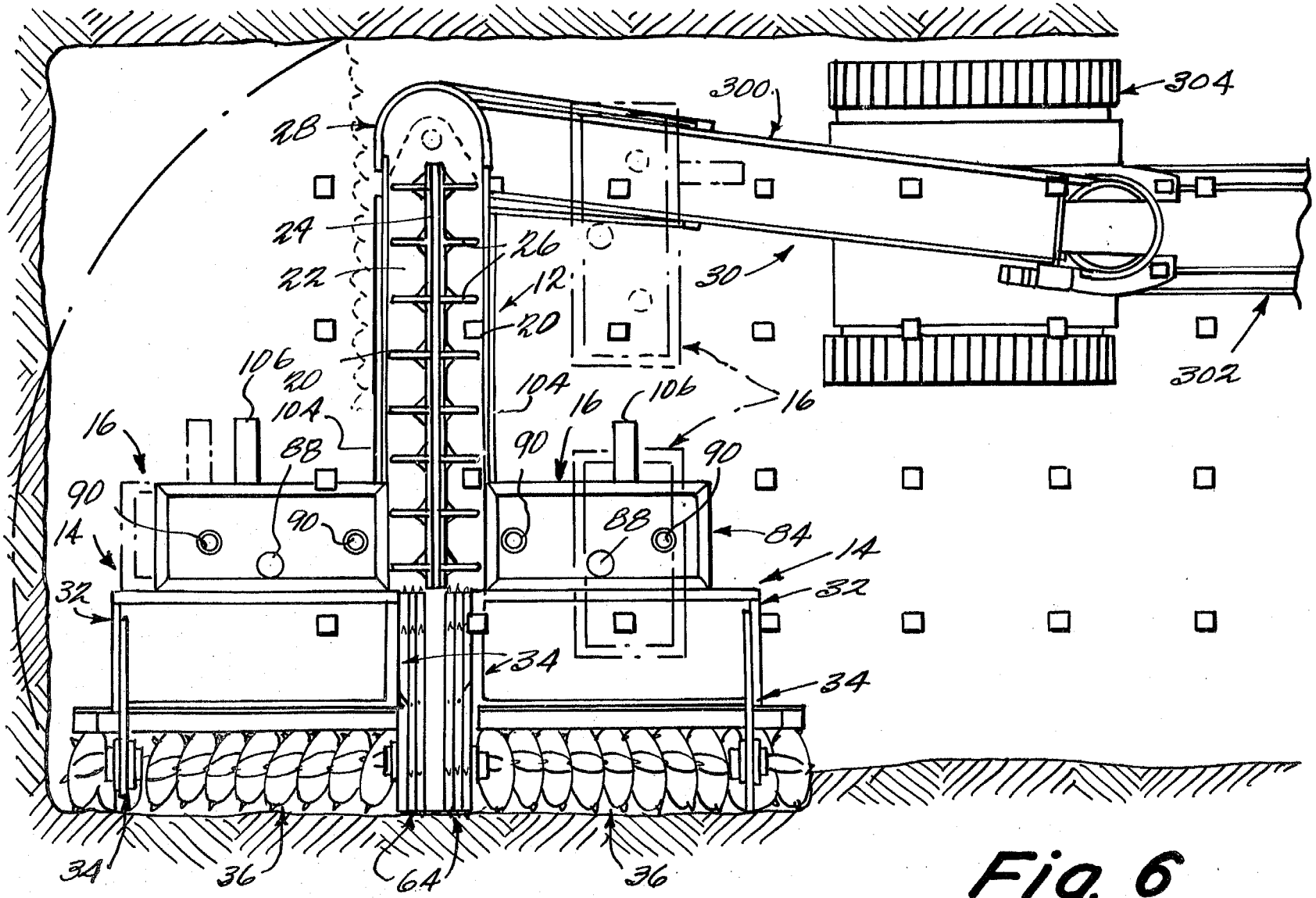
FIG. 6 is a top plan view of the continuous mining machine showing the parts in the position assumed at the end of the turning movement.

Referring now more particularly to FIGS. 4–6, when it is desired to develop the seam in a direction constituting a 90° turn from the entry being formed, the continuous mining machine 10 is moved rearwardly away from the working face which has been established in the entry. An appropriate back-off distance is illustrated in phantom lines in FIG. 6 which also illustrates the pattern of roof bolting during the formation of the entry by the normal advancing cycle of operation previously described. FIG. 4 illustrates the position of the continuous mining machine 10 preparatory to a turning operation to the left. The description is of a left-hand turn, it being understood that the execution of a right-hand turn involves merely reversing the operation of the left and right-hand canopy units 16. It will be noted that since there is some engagement of the outer auger sections during the turning operation, both auger cutter units 36 are power operated through energization of the respective motor 74. The turning movement can be accomplished with the auger cutters 36 either in the lowered position or their raised position, or any position therebetween. The purpose of actuating the cutting units is primarily merely to cut clearance for the auger cutter units 36 during the turning operation. The turning operation is essentially a non-coal gaining operation.

Where a left-hand turn is to be executed, the left-hand canopy unit 16 is initially disposed in a position rearwardly adjacent the associated cutting and conveying mechanism 14. Hydraulic piston and cylinder unit 106 is retracted. The engagement of the slide elements 98 and 102 of the left-hand canopy unit 16 with the associated rod 104 fixed to the central conveyor assembly 12 together with the connection of the hydraulic piston and cylinder unit 106 with the clevis 110 and the fixed connection of the movable plate 112 provided by locked hydraulic ram 112 insures that so long as hydraulic piston and cylinder unit 106 is not actuated, the left-hand canopy unit will be maintained in a fixed position with respect to the associated cutting and conveying mechanism 14 and central conveying assembly 12. When the canopy structure 84 of the left-hand canopy unit 16 is extended into anchored relation to the mine roof by actuating the hydraulic rams 86, the anchoring points 88 and 89 provide a vertical pivotal axis of turning for the left-hand canopy unit 16 and all of the structure of the continuous mining machine 10 fixedly associated therewith, including the left-hand cutting and conveying mechanism 14, central conveyor assembly 12, and the right-hand cutting and conveying mechanism 14.

In order to effect the turning movement, the right-hand canopy unit 16 is initially moved laterally horizontally outwardly into the position shown in FIG. 4. In order to effect this movement, hydraulic piston and cylinder units 96 and 100 are actuated to move the associated C-shaped slide elements 98 and 102 out of engagement with the associated rod 104. Next, the lug 122 of the right-hand canopy unit 16 is pinned by the pin 120 to the lug 118 and the piston rod end of the hydraulic ram 124. The latter can then be actuated to effect a lateral horizontal movement of the right-hand canopy unit 116 into laterally spaced relation with respect to the central conveyor assembly 12. Lug 122 is then uncoupled from pin 120.

With the right-hand canopy unit 16 in the position shown in FIG. 4, the associated hydraulic rams 86 are actuated to move the canopy structure 84 thereof into anchored relation with the mine roof. The associated hydraulic piston and cylinder unit 106 can now be actuated through a full 4' stroke, during which time the clevis 110 permits a pivotal movement between the piston rod end of the hydraulic piston and cylinder unit 106 with respect to the associated cutting and conveying unit 14 while the pivot elements 88 and 98 of the associated right-hand canopy unit 16 permit the canopy unit 16 to also pivot about a vertical axis. After the hydraulic piston and cylinder unit 106 has been fully extended, as shown in FIG. 5, the hydraulic rams 86 are actuated to lower the associated canopy unit and then the unit 106 is retracted to pull the canopy unit 16 into a position adjacent the right-hand cutting and conveying unit 14. The above cycle is repeated until the entire continuous mining machine 10 is turned through a full 90° turning movement. The position of the continuous mining machine after the turning movement and the interrelated position of the bridge conveyor assembly 30 is shown in FIG. 6, it being understood that actuation of the endless track assembly 304 thereof has been undertaken as appropriate.

TRANSPORTING OPERATION

As a matter of convenience in describing the movement of the auger cutter units 36 of the continuous mining machine 10 from their normal operative position as shown in FIG. 1 to their transporting position as shown in FIG. 8, it will be assumed that the components of the continuous mining machine 10 are in the positions shown in FIGS. 1 and 2. The auger cutter units 36 are moved from the position shown into their transporting position sequentially, although the particular sequence, that is, which is first and which is second, does not matter. For the sake of convenience it is assumed that the right-hand auger cutter unit 36 is to be moved first.

In order to effect this movement, the hydraulic rams 86 of the right-hand canopy unit 16 are actuated to lower the right-hand canopy structure 84 out of engagement with the mine roof. Next the right-hand telescoping unit 106 is actuated to extend the same, which has the effect of moving the right-hand canopy unit 16 rearwardly with respect to the associated right-hand cutting and conveying mechanism 14 as well as the other left-hand cutting and conveying mechanism 14, and the central conveyor 12, which is retained in position by virtue of the mine floor-to-roof anchoring relationship of the left-hand canopy unit 16.

When the right-hand unit 106 has been fully extended through its 4' plus stroke, the hydraulic rams 86 are again actuated to raise the left-hand canopy structure 84 into engagement with the roof so as to anchor the same in the position to which it has been moved. The unit 106 of the right-hand canopy unit is then actuated to retract the same. Subsequent to this movement, the controls for the right-hand hydraulic piston and cylinder unit 124 are moved from their normal locked position to an idling position, enabling the associated right-hand sliding member 112 to move laterally outwardly within its guide tracks 116. Thus, the retraction of the unit 106 will have the effect of pivoting the right-hand cutting and conveying mechanism 14 rearwardly about its vertical pivotal axis 38, which pivotal movement is accommodated by the lateral movement of slide member 112 carrying clevis 10. At the end of this pivotal movement, the right-hand cutting and conveying mechanism 14 will be disposed rearwardly adjacent the right-hand canopy unit 16 but angled with respect thereto. The canopy unit 16 is disposed in an intermediate position of longitudinal movement with respect to the positions shown in FIGS. 1 and 7.

Figure 7:
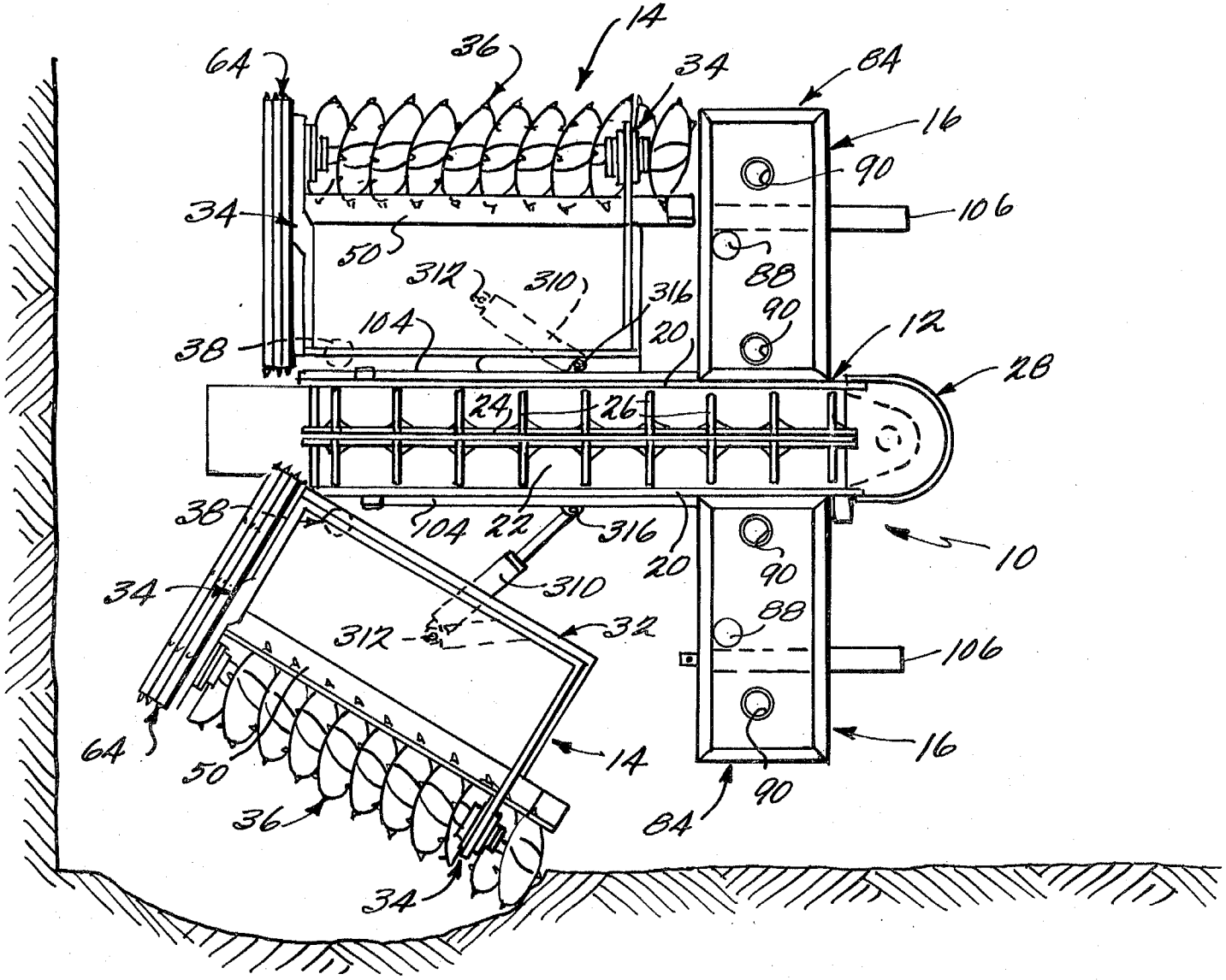
FIG. 7 is a top plan view of the forward portion of the continuous mining machine showing the parts in a position assumed during the movement of the machine into a transporting condition.

With the parts in the position indicated above, hydraulic rams 86 of the right-hand canopy unit 16 are again actuated to lower the right-hand canopy structure 84 out of engagement with the mine roof and after this has been accomplished, the right-hand unit 106 is actuated to extend the same, which has the effect of moving the right-hand canopy unit 16 to its rearwardmost position, as shown in FIG. 7. The hydraulic rams 86 are again actuated to raise the right-hand canopy structure 84 into anchored relation with the mine roof after which the unit 106 is retracted, which again has the effect of pivoting the right-hand cutting and conveying mechanism 14 about its vertical pivotal axis 38, the lateral sliding movement of the slide member 112 accommodating this pivotal movement. At the end of this movement the angular relationship of the right-hand cutting and conveying mechanism 14 is comparable to the angular position in which the left-hand cutting and conveying mechanism 14 is shown in FIG. 7. In this position, the piston rod end of the right-hand unit 106 is disengaged from the right-hand clevis 110 and the unit 106 is fully retracted.

In order to effect a pivotal movement of the right-hand cutting and conveying mechanism 14 from the position described above into its transporting position, as shown in FIG. 7, there is provided a hydraulic ram 310, the cylinder end of which is pivotally carried in an elevated position above the associated floor engaging plate 32 by a study or the like, as indicated at 312 in FIG. 11. The hydraulic ram 310 is swingable in a horizontal plane through an opening 314 formed in the plate 114 (see FIG. 13). When the cutting and conveying mechanism 14 is disposed in the angled position previously described, the hydraulic ram 310 can be pivoted through the slot 314 and, when fully extended, its piston rod end can be connected with a lug 316 fixed to the adjacent side frame plate 20 of the central conveyor assembly 12. After this connection has been made, retraction of the hydraulic ram 310 will effect a pivotal movement of the right-hand cutting and conveying mechanism 14 into its transporting position, as shown in FIG. 7. A locking cylinder 318 is carried by the frame of the conveyor assembly 12 in a position such that when it is extended the piston rod end thereof serves as a bolt lock to lock the right-hand cutting and conveying mechanism 14 into its transporting position.

It will be understood that similar hydraulic rams 310 and 318 are provided for the left-hand side of the continuous mining machine. Consequently, it will be understood that after the right-hand cutting and conveying mechanism 14 has been moved into its transporting position, the left-hand cutting and conveying mechanism 14 is moved into its transporting position by a similar procedure. It will be understood that the aforesaid rearward swinging movement can be accomplished with the motor 74 of the associated auger cutter unit 36 energized so that the auger cutter unit will cut clearance for itself, when required, as is indicated in FIG. 7. After the left-hand cutting and conveying mechanism 14 has been pivoted into its transporting position as shown in FIG. 8, the hydraulic rams 86 associated with both canopy units 16 are actuated to lower both of the canopy structures 84 out of anchored relation with respect to the mine roof. Next, hydraulic rams 46 are actuated to move the associated endless track assemblies 40 downwardly with respect to the associated floor engaging plates 42. This has the effect of raising the entire continuous mining machine 10 out of supported relation with respect to the mine floor except for the support provided through the two endless track assemblies 40, the lower flights of which are disposed in ground engagement in parallel relation to one another. The continuous mining machine 10 and bridge conveyor assembly 30 can now be moved conveniently to any part of the mine desired by the operation of the endless track assemblies 40 through hydraulic motors 47 and the endless track assemblies 304.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A continuous mining machine comprising power driven cutting and conveying means operable when moved with respect to a working face of a mine seam including horizontal movement in a direction inwardly of the working face to remove the material from a section of the mine seam inwardly of the working face and to convey the same away from the working face, said cutting and conveying means including an elongated conveyor assembly extending in a direction generally in alignment with the direction of horizontal movement so as to receive removed material at its forward end and convey the material away from the working face to the rearward end thereof, and a pair of cutting and conveying mechanisms extending laterally outwardly from opposite sides of said conveyor assembly and being operable to convey the removed material laterally toward the forward end of said conveyor assembly, each of said cutting and conveying mechanisms including a mine floor engaging assembly, a rotary auger cutter, a mounting arm assembly rotatably supporting said rotary auger cutter for rotational movement about a lateral horizontally extending axis generally parallel to the working face, means mounting said mounting arm assembly on said floor engaging assembly for pivotal movement about an axis parallel with the axis of rotation of said rotary auger cutter, power means carried by said floor engaging assembly operatively connected with said rotary auger cutter for effecting rotation of said rotary auger cutter about the rotational axis thereof, and means between said mounting arm means and said floor engaging assembly for effecting a raising and lowering pivotal movement of said rotary auger cutter about the pivotal axis of said mounting arm assembly, a pair of separate mine floor engaging structures disposed on opposite sides of said conveyor assembly rearwardly of said pair of cutting and conveying mechanisms, mine roof engaging means disposed above each of said mine floor engaging structures, means mounting each of said mine roof engaging means for vertical movement with respect to the associated floor engaging structure, means mounting each of said floor engaging structures for relative horizontal movement with respect to the associated cutting and conveying mechanism, and power operated means for (I) effecting vertical movements of each of said roof engaging means with respect to the associated floor engaging structure and (II) effecting relative horizontal movement between each floor engaging structure and associated cutting and conveying mechanism so that (A) successive sections of the mine seam can be removed by successive operative cycles, each of which includes (1) an upward movement of both of said roof engaging means into an operative position of engagement with the mine roof to thereby provide an anchored relationship of both of said floor engaging structures between the mine floor and roof, (2) generally simultaneous horizontal movement of both of said cutting and conveying mechanisms with both of said floor engaging structures disposed in said anchored relationship through forces resisted by said anchored relationship, (3) a downward movement of each of said roof engaging means out of said operative position, and (4) horizontal movement of each of said mine floor engaging structures with respect to the associated cutting and conveying mechanism with the associated mine roof engaging means disposed out of said operative position in a direction and to an extent generally equal to the horizontal movement of said cutting and conveying means, (B) the continuous mining machine can be moved through a 90° turn by an operative cycle with includes (1) an upward movement of one of said roof engaging means into an operative position of engagement with the mine roof to thereby provide an anchored vertical pivot relationship of the associated floor engaging structure between the mine floor and roof and (2) a repetitive series of successive movements of the floor engaging structure and the other roof engaging means associated therewith which includes (a) upward movement of said other roof engaging means into an operative position of engagement with the mine roof to thereby provide an anchored relationship of said other floor engaging structure between the mine floor and roof, (b) horizontal movement of the cutting and conveying mechanism associated with said other floor engaging structure with the latter disposed in said anchored relationship through a force resisted by said anchored relationship so as to move the entire machine about the anchored vertical pivot relationship provided by said one floor engaging structure, (c) downward movement of said other roof engaging means out of said operative position, (d) horizontal movement of said other mine roof engaging structure with respect to the associated cutting and conveying mechanism with said other mine roof engaging means disposed out of said operative position.

2. A continuous mining machine as defined in claim 1 wherein between each of said floor engaging assemblies and said conveyor assembly means is provided for mounting the associated floor engaging assembly for movement between (1) a normal operating position wherein the pivotal axes of said mounting arm assemblies are in alignment and the axes of said auger cutters are movable through a common plane arcuate thereto, and (2) a transporting position wherein the auger cutters associated with said floor engaging assemblies are disposed laterally outwardly with their axes generally parallel and on opposite sides of the central portion of said conveyor assembly, the lateral horizontal distance between the lateral outermost points on said auger cutters when in said normal operative position being substantially greater than the lateral horizontal distance between the lateral outermost points on said auger cutters when in said transport position.

3. A continuous mining machine as defined in claim 2, wherein each of said mine floor engaging assemblies includes a power driven endless track unit having a floor engaging flight, the floor engaging flights of said endless track units being disposed in parallel relation with respect to one another when said floor engaging assemblies are disposed in said transporting position.

4. A continuous mining machine as defined in claim 3, wherein each of said mine floor engaging assemblies includes a horizontal floor engaging plate, means for mounting each of said endless track units on the associated floor engaging plate for vertical movement with respect thereto and power operated means operable when said floor engaging assemblies are disposed in said transport position with said endless track units in floor engaging relation to effect an upward movement of said plates with respect thereto out of floor engaging relation.

5. A continuous mining machine as defined in claim 4 wherein each of said mine roof engaging means includes a horizontally extending canopy structure disposed above the associated mine floor engaging structure, means carried by each of said floor engaging structures for facilitating the installation of a mine roof bolt in the mine roof, said power operated means being operable in conjunction with the upward movment of each roof engaging means into an operative position of engagement with the mine roof during each operative cycle to thereby provide a mine roof area directly under which the associated canopy structure is disposed for protecting an operator from roof fall from said area and to effect during each opertive cycle an operation of each roof bolt installing means with the associated roof engaging means in said operative position so as to install a mine roof bolt in the mine roof in a position closely adjacent the associated protected roof area.

6. A continuous mining machine as defined in claim 5 wherein each roof bolt installing means comprises a rotatable head assembly for receiving successively a roof drill and a roof bolt, means mounting said head assembly on the associated floor engaging structure for vertical movement with respect thereto, said power operated means including means for effecting vertical movement of said head assembly and for effecting rotation of said head assembly so that the roof bolt installing means can be operated through successive cycles each of which includes (1) raising and rotating said head assembly to move a roof drill received therein upwardly into hole drilling relation to the mine roof while being turned by said head assembly, (2) lowering the roof drill received in said head assembly from a hole drilled in the mine roof thereby, (3) raising a roof bolt received in said head assembly into the drilled hole and turning the same thereafter to effect securement of the roof bolt in the drilled hole and (4) lowering said assembly after securement of the roof bolt within the drilled hole.

7. A continuous mining machine as defined in claim 5 wherein each of said canopy structures provides a protected roof area having a lateral dimension in excess of four feet, each of said canopy structures having a pair of laterally spaced openings therein for passage of roof drills and roof bolts therethrough, said two pairs of openings being spaced laterally apart approximately four feet between adjacent openings.

8. A continuous mining machine as defined in claim 7 wherein the roof bolt installing means associated with each floor engaging means comprises a pair of laterally spaced rotatable head assemblies for receiving successively a roof drill and a roof bolt, means mounting each head assembly on the associated floor engaging structure for vertical movement with respect thereto with its rotation axis aligned with an opening in the associated canopy structure, said power operated means including means for effecting vertical movement of each head assembly and for effecting rotation of each head assembly so that the roof bolt installing means can be operated through successive cycles each of which includes (1) raising and rotating each head assembly to move a roof drill received therein upwardly into hole drilling relation to the mine roof while being turned by each head assembly, (2) lowering the roof drill received in each head assembly from a hole drilled in the mine roof thereby, (3) raising a roof bolt received in each head assembly into the drilled hole and turning the same thereafter to effect securement of the roof bolt in the drilled hole and (4) lowering each head assembly after securement of the roof bolt within the drilled hole.

9. A continuous mining machine as defined in claim 8 wherein said means mounting each of said floor engaging structures for relative horizontal movement with respect to the associated cutting and conveying mechanism comprises a longitudinally horizontal sliding connection between the associated floor engaging structure and an adjacent side of said conveyor assembly and a longitudinally horizontal telescoping unit between the associated floor engaging structure and the associated cutting and conveying mechanism.

10. A continuous mining machine as defined in claim 9 wherein said telescoping unit comprises a piston and cylinder and said power operated means includes hydraulic fluid for effecting telescoping movement of said piston and cylinder.

11. A continuous mining machine as defined in claim 9 wherein the horizontal sliding connection for each floor engaging structure comprises an elongated horizontal member fixedly secured to the associated side of said conveyor assembly in longitudinally extending relation, slide elements carried by the associated floor engaging structure movable between a position of sliding engagement with respect to the associated elongated member and a position out of engagement therewith permitting relative lateral horizontal movement of the associated floor engaging structure with respect to said conveyor assembly.

12. A continuous mining machine as defined in claim 11 wherein said means mounting each of said floor engaging structures for relative horizontal movement with respect to the associated cutting and conveying mechanism includes a connecting member connected with floor engaging structure mounted on the associated cutting and conveying mechanism for lateral horizontal movement between a normal operating position and a turning position so that when the associated slide elements are disposed in their out-of-engagement position the associated floor engaging structure will be moved by said connecting member into a corresponding turning position spaced laterally outwardly from the associated side of said conveyor assembly.

13. A continuous mining machine as defined in claim 1 wherein each of said mine roof engaging means includes a horizontally extending canopy structure disposed above the associated mine floor engaging structure, means carried by each of said floor engaging structures for facilitating the installation of a mine roof bolt in the mine roof, said power operated means being operable in conjunction with the upward movement of each roof engaging means into an operative position of engagement with the mine roof during each operative cycle to thereby provide a mine roof area directly under which the associated canopy structure is disposed for protecting an operator from roof fall from said area and to effect during each operative cycle an operation of each roof bolt installing means with the associated roof engaging means in said operative position so as to install a mine roof bolt in the mine roof in a position closely adjacent the associated protected roof area.

14. A continuous mining machine as defined in claim 13 wherein each of said canopy structures provides a protected roof area having a lateral dimension in excess of four feet, each of said canopy structures having a pair of laterally spaced openings therein for passage of roof drills and roof bolts therethrough, said two pairs of openings being spaced laterally apart approximately four feet between adjacent openings.

15. A continuous mining machine as defined in claim 14 wherein the roof bolt installing means associated with each floor engaging means comprises a pair of laterally spaced rotatable head assemblies for receiving successively a roof drill and a roof bolt, means mounting each head assembly on the associated floor engaging structure for vertical movement with respect thereto with its rotation axis aligned with an opening in the associated canopy structure, said power operated means including means for effecting vertical movement of each head assembly and for effecting rotation of each head assembly so that the roof bolt installing means can be operated through successive cycles each of which includes (1) raising and rotating each head assembly to move a roof drill received therein upwardly into hole drilling relation to the mine and roof while being turned by each head assembly, (2) lowering the roof drill received in each head assembly from a hole drilled in the mine roof thereby, (3) raising a roof bolt received in each head assembly into the drilled hole and turning the same thereafter to effect securement of the roof bolt in the drilled hole and (4) lowering each head assembly after securement of the roof bolt within the drilled hole.

16. A continuous mining machine as defined in claim 1 wherein said means mounting each of said floor engaging structures for relative horizontal movement with respect to the associated cutting and conveying mechanism comprises a longitudinally horizontal sliding connection between the associated floor engaging structure and an adjacent side of said conveyor assembly and a longitudinally horizontal telescoping unit between the associated floor engaging structure and the associated cutting and conveying mechanism.

17. A continuous mining machine as defined in claim 16 wherein said telescoping unit comprises a piston and cylinder and said power operated means includes hydraulic fluid for effecting telescoping movement of said piston and cylinder.

18. A continuous mining machine as defined in claim 16 wherein the horizontal sliding connection for each floor engaging structure comprises an elongated horizontal member fixedly secured to the associated side of said conveyor assembly in longitudinally extending relation, slide elements carried by the associated floor engaging structure movable between a position of sliding engagement with respect to the associated elongated member and a position out of engagement therewith permitting relative lateral horizontal movement of the associated floor engaging structure with respect to said conveyor assembly.

19. A continuous mining machine as defined in claim 18 wherein said means mounting each of said floor engaging structures for relative horizontal movement with respect to the associated cutting and conveying mechanism includes a connecting member connected with floor engaging structure mounted on the assocated cutting and conveying mechanism for lateral horizontal movement between a normal operating position and a turning position so that when the associated side elements are disposed in their out-of-engagement position the associated floor engaging structure will be moved by said connecting member into a corresponding turning position spaced laterally outwardly from the associated side of said conveyor assembly.

20. A continuous mining machine comprising power driven cutting and conveying means operable when moved with respect to a working face of a mine seam including horizontal movement in a direction inwardly of the working face to remove the material from a section of the mine seam inwardly of the working face and to convey the same away from the working face, said cutting and conveying means including an elongated conveyor assembly extending in a direction generally in alignment with the direction of horizontal movement so as to receive removed material at its forward end and convey the material away from the working face to the rearward end thereof, and a pair of cutting and conveying mechanisms extending laterally outwardly from opposite sides of said conveyor assembly and being operable to convey the removed material laterally toward the forward end of said conveyor assembly, each of said cutting and conveying mechanisms including a mine floor engaging assembly, a rotary auger cutter, a mounting arm assembly rotatably supporting said rotary auger cutter for rotational movement about a lateral horizontally extending axis generally parallel with the working face of the mine seam, means mounting said mounting arm assembly on said floor engaging assembly for pivotal movement about an axis parallel with the axis of rotation of said rotary auger cutter, power means carried by said floor engaging assembly operatively connected with said rotary auger cutter for effecting rotation of said rotary auger cutter about the rotational axis thereof, and means between said mounting arm means and said floor engaging assembly for effecting a raising and lowering pivotal movement of said rotary auger cutter about the pivotal axis of said mounting arm assembly, a pair of separate mine floor engaging structures disposed on opposite sides of said conveyor assembly rearwardly of said pair of cutting and conveying mechanisms, mine roof engaging means disposed above each of said mine floor engaging structures, means mounting each of said mine roof engaging means for vertical movement with respect to the associated floor engaging structure, means mounting each of said floor engaging structures for relative horizontal movement with respect to the associated cutting and conveying mechanism, power operated means for (1) effecting vertical movements of each of said roof engaging means with respect to the associated floor engaging structure and (II) effecting relative horizontal movement between each floor engaging structure and associated cutting and conveying mechanism so that (A) successive sections of the mine seam can be removed by successive operative cycles, each of which includes (1) an upward movement of both of said roof engaging means into an operative position of engagement with the mine roof to thereby provide an anchored relationship of both of said floor engaging structures between the mine floor and roof, (2) generally simultaneous horizontal movement of both of said cutting and conveying mechanisms with both of said floor engaging structures disposed in said anchored relationship through forces resisted by said anchored relationship, (3) a downward movement of each of said roof engaging means out of said operative position, and (4) horizontal movement of each of said mine floor engaging structures with respect to the associated cutting and conveying mechanism with the associated mine roof engaging means disposed out of said operative position in a direction and to an extent generally equal to the horizontal movement of said cutting and conveying means, and means between each of said floor engaging assemblies and said conveyor assembly for mounting the associated floor engaging assembly for movement between (1) a normal operating position wherein the pivotal axes of said mounting arm assemblies are in alignment and the axes of said auger cutters are movable through a common plane arcuate thereto, and (2) a transporting position wherein the auger cutters associated with said floor engaging assemblies are disposed laterally outwardly with their axes generally parallel and on opposite sides of the central portion of said conveyor assembly, the lateral horizontal distance between the lateral outermost points on said auger cutters when in said normal operative position being substantially greater than the lateral horizontal distance between the lateral outermost points on said auger cutters when in said transport position.

21. A continuous mining machine as defined in claim 20, wherein each of said mine floor engaging assemblies includes a power driven endless track unit having a floor engaging flight, the floor engaging flights of said endless track units being disposed in parallel relation with respect to one another when said floor engaging assemblies are disposed in said transporting position.

22. A continuous mining machine as defined in claim 21, wherein each of said mine floor engaging assemblies includes a horizontal floor engaging plate, means for mounting each of said endless track units on the associated floor engaging plate for vertical movement with respect thereto and power operated means operable when said floor engaging assemblies are disposed in said transport position with said endless track units in floor engaging relation to effect an upward movement of said plates with respect thereto out of floor engaging relation.

23. A continuous mining machine comprising:

a mine floor engaging structure, mine roof engaging means including a horizontally extending canopy structure disposed above said mine floor engaging structure, means mounting said mine roof engaging means for vertical movement with respect to said floor engaging structure, means carried by said floor engaging structure for facilitating the installation of a mine roof bolt in the mine roof, power driven cutting and conveying means operable when moved with respect to a working face of a mine seam including horizontal movement in a direction inwardly of the working face to remove the material from a section of the mine seam inwardly of the working face and to convey the same away faom the working face, means mounting said floor engaging structure for relative horizontal movement with respect to said cutting and conveying means, and power operated means for (1) effecting vertical movements of said roof engaging means with respect to said floor engaging structure, (2) effecting relative horizontal movement between said floor engaging structure and said cutting and conveying means, and (3) operative movement of said roof bolt installing means so that successive sections of the mine seam can be removed by successive operative cycles, each of which includes (a) an upward movement of said roof engaging means into an operative position of engagement with the mine roof to thereby provide an anchored relationship of said floor engaging structure between the mine floor and roof and a protected mine roof area directly under which said canopy structure is disposed (b) an operation of said roof bolt installing means with said roof engaging means in said operative position so as to install a mine roof bolt in the mine roof in a position closely adjacent said protected roof area, (c) horizontal movement of said cutting and conveying means with said floor engaging structure disposed in said anchored relationship through a force resisted by said anchored relationship, (d) a downward movement of said roof engaging means out of said operative position, and (e) horizontal movement of said mine floor engaging structure with respect to said cutting and conveying means with said mine roof engaging means disposed out of said operative position in a direction and to an extent generally equal to the horizontal movement of said cutting and conveying means.

24. A continuous mining machine as defined in claim 23 wherein each roof bolt installing means comprises a rotatable head assembly for receiving successively a roof drill and a roof bolt, means mounting said head assembly on the associated floor engaging structure for vertical movement with respect thereto, said power operated means including means for effecting vertical movement of said head assembly and for effecting rotation of said head assembly so that the roof bolt installing means can be operated through successive cycles each of which includes (1) raising and rotating said head assembly to move a roof drill received therein upwardly into hole drilling relation to the mine roof while being turned by said head assembly, (2) lowering the roof drill received in said head assembly from a hole drilled in the mine roof thereby, (3) raising a roof bolt received in said head assembly into the drilled hole and turning the same thereafter to effect securement of the roof bolt in the drilled hole and (4) lowering said assembly after securement of the roof bolt within the drilled hole.

25. A continuous mining machine as defined in claim 23 wherein each of said cutting and conveying mechanisms includes:

a mine floor engaging assembly, a rotary auger cutter, a mounting arm assembly rotatably supporting said rotary auger cutter for rotational movement about a lateral horizontally extending axis generally parallel to the working face, means mounting said mounting arm assembly on said floor engaging assembly for pivotal movement about an axis parallel with the axis of rotation of said rotary auger cutter, power means carried by said floor engaging asembly operatively connected with said rotary auger cutter for effecting rotation of said rotary auger cutter about the rotational axis thereof, and means between said mounting arm means and said floor engaging assembly for effecting a raising and lowering pivotal movement of said rotary auger cutter about the pivotal axis of said mounting arm assembly.

26. A continuous mining machine as defined in claim 25 wherein between each of said floor engaging assemblies and said conveyor assembly means is provided for mounting the associated floor engaging assembly for movement between (1) a normal operating position wherein the pivotal axes of said mounting arm assemblies are in alignment and the axes of said auger cutters are movable through a common plane arcuate thereto, and (2) a transporting position wherein the auger cutters associated with said floor engaging assemblies are disposed laterally outwardly with their axes generally parallel and on opposite sides of the central portion of said conveyor assembly, the lateral horizontal distance between the lateral outermost points on said auger cutters when in said normal operative position being substantially greater than the lateral horizontal distance between the lateral outermost points on said auger cutters when in said transport position.

27. A continuous mining machine as defined in claim 26 wherein each of said mine floor engaging assemblies includes a power driven endless track unit having a floor engaging flight, the floor engaging flights of said endless track units being disposed in parallel relation with respect to one another when said floor engaging assemblies are disposed in said transporting position.

28. A continuous mining machine as defined in claim 27, wherein each of said mine floor engaging assemblies includes a horizontal floor engaging plate, means for mounting each of said endless track units on the associated floor engaging plate for vertical movement with respect thereto and power operated means operable when said floor engaging assemblies are disposed in said transport position with said endless track units in floor engaging relation to effect an upward movement of said plates with respect thereto out of floor engaging relation.

29. A continuous mining machine as defined in claim 28 wherein each roof bolt installing means comprises a rotatable head assembly for receiving successively a roof drill and a roof bolt, means mounting said head assembly on the associated floor engaging structure for vertical movement with respect thereto, said power operated means including means for effecting vertical movement of said head assembly and for effecting rotation of said head assembly so that the roof bolt installing means can be operated through successive cycles each of which includes (1) raising and rotating said head assembly to move a roof drill received therein upwardly into hole drilling relation to the mine roof while being turned by said head assembly, (2) lowering the roof drill received in said head assembly from a hole drilled in the mine roof thereby, (3) raising a roof bolt received in said head assembly into the drilled hole and turning the same thereafter to effect securement of the roof bolt in the drilled hole and (4) lowering said assembly after securement of the roof bolt within the drilled hole.

30. a continuous mining machine comprising power driven cutting and conveying means operable when moved with respect to a working face of a mine seam including horizontal movement in a direction inwardly of the working face to remove the material from a section of the mine seam inwardly of the working face and to convey the same away from the working face, said cutting and conveying means including an elongated conveyor assembly extending in a direction generally in alignment with the direction of horizontal movement so as to receive removed material at its forward end and convey the material away from the working face to the rearward end thereof, and a pair of cutting and conveying mechanisms extending laterally outwardly from opposite sides of said conveyor assembly and being operable to convey the removed material laterally toward the forward end of said conveyor assembly, each of said cutting and conveying mechanisms including a mine floor engaging assembly, a rotary auger cutter, a mounting arm assembly rotatably supporting said rotary auger cutter for rotational movement about a lateral horizontally extending axis generally parallel to the working face, means mounting said mounting arm assembly on said floor engaging assembly for pivotal movement about an axis parallel with the axis of rotation of said rotary auger cutter, power means carried by said floor engaging assembly operatively connected with said rotary auger cutter for effecting rotation of said rotary auger cutter about the rotational axis thereof, and means between said mounting arm means and said floor engaging assembly for effecting a raising and lowering pivotal movement of said rotary auger cutter about the pivotal axis of said mounting arm assembly, and means mounting each of said floor engaging assemblies with respect to said conveyor assembly for movement between (1) a normal operating position wherein the pivotal axes of said mounting arm assemblies are in alignment and the axes of said auger cutters are movable through a common plane arcuate thereto, and (2) a transporting position wherein the auger cutters associated with said floor engaging assemblies are disposed laterally outwardly with their axes generally parallel and on opposite sides of the central portion of said conveyor assembly, the lateral horizontal distance between the lateral outermost points on said auger cutters when in said normal operative position being substantially greater than the lateral horizontal distance between the lateral outermost points on said auger cutters when in said transportion position.

31. A continuous mining machine as defined in claim 30, wherein each of said mine floor engaging assemblies includes a power driven endless track unit having a floor engaging flight, the floor engaging flights of said endless track units being disposed in parallel relation with respect to one another when said floor engaging assemblies are disposed in said transporting position.

32. A continuous mining machine as defined in claim 31 wherein each of said mine floor engaging assemblies includes a horizontal floor engaging plate, means for mounting each of said endless track units on the associated floor engaging plate for vertical movement with respect thereto and power operated means operable when said floor engaging assemblies are disposed in said transport position with said endless track units in floor engaging relation to effect an upward movement of said plates with respect thereto out of floor engaging relation.

* * * * *